US009847088B2

(12) United States Patent
Peters et al.

(10) Patent No.: US 9,847,088 B2
(45) Date of Patent: Dec. 19, 2017

(54) INTERMEDIATE COMPRESSION FOR HIGHER ORDER AMBISONIC AUDIO DATA

(71) Applicant: QUALCOMM Incorporated, San Diego, CA (US)

(72) Inventors: Nils Günther Peters, San Diego, CA (US); Dipanjan Sen, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 99 days.

(21) Appl. No.: 14/838,066

(22) Filed: Aug. 27, 2015

(65) Prior Publication Data

US 2016/0064005 A1 Mar. 3, 2016

Related U.S. Application Data

(60) Provisional application No. 62/043,987, filed on Aug. 29, 2014, provisional application No. 62/145,402, (Continued)

(51) Int. Cl.

| | |
|---|---|
| ***H04R 5/00*** | (2006.01) |
| ***G10L 19/008*** | (2013.01) |
| ***H04H 60/07*** | (2008.01) |
| ***G10L 19/16*** | (2013.01) |
| ***H04S 3/00*** | (2006.01) |
| ***H04H 20/89*** | (2008.01) |

(52) U.S. Cl.

CPC ..... *G10L 19/008* (2013.01); *G10L 19/167* (2013.01); *H04H 20/89* (2013.01); *H04H 60/07* (2013.01); *H04S 3/008* (2013.01); *H04S 2420/11* (2013.01)

(58) Field of Classification Search

CPC ..... G10L 19/008; G10L 19/167; H04H 20/89; H04H 60/07; H04S 3/008; H04S 2420/11

See application file for complete search history.

(56) References Cited

U.S. PATENT DOCUMENTS

2010/0158098 A1 6/2010 McSchooler et al.
2012/0155653 A1 6/2012 Jax et al.
(Continued)

FOREIGN PATENT DOCUMENTS

EP 2450880 A1 5/2012
WO 2014194099 A1 12/2014

OTHER PUBLICATIONS

"Proposed 14496-26, Audio Conformance," MPEG Meeting; Jul. 21-25, 2008; Hannover; (Motion Picture Expert Group or ISO/IEC JTC1/SC29/WG11), No. N10041, Jul. 26, 2008, XP030016535, 182 pp., ISSN: 0000-0039, Section 6.8.2.2.
(Continued)

*Primary Examiner* — Andrew L Sniezek
(74) *Attorney, Agent, or Firm* — Shumaker & Sieffert, P.A.

(57) ABSTRACT

In general, techniques are directed to intermediate compression of higher order ambisonic audio data. For example, a device comprising a processor and a memory may be configured to perform the techniques. The memory may be configured to store an intermediately formatted audio data generated as a result of an intermediate compression of higher order ambisonic audio data. The one or more processors may be configured to process the intermediately formatted audio data.

27 Claims, 14 Drawing Sheets

Related U.S. Application Data filed on Apr. 9, 2015, provisional application No. 62/146,115, filed on Apr. 10, 2015.

(56) References Cited

U.S. PATENT DOCUMENTS

| | | | | |
|---|---|---|---|---|
| 2012/0275509 | A1 | 11/2012 | Smith et al. | |
| 2012/0314878 | A1* | 12/2012 | Daniel | G10L 19/20 381/23 |
| 2013/0216070 | A1 | 8/2013 | Keiler et al. | |
| 2013/0236039 | A1* | 9/2013 | Jax | H04S 7/302 381/307 |
| 2015/0213803 | A1 | 7/2015 | Peters et al. | |
| 2015/0341736 | A1 | 11/2015 | Peters et al. | |
| 2015/0373473 | A1 | 12/2015 | Boehm et al. | |
| 2016/0099001 | A1 | 4/2016 | Peters et al. | |
| 2016/0125890 | A1 | 5/2016 | Jax et al. | |
| 2016/0150341 | A1 | 5/2016 | Kordon et al. | |

OTHER PUBLICATIONS

International Search Report and Written Opinion from International Application No. PCT/US2015/047461, dated Mar. 18, 2016, 20 pp.

Tektronix: "Monitoring Surround-Sound Audio," Internet Citation, Jul. 2005, 32 pp., XP007904948, Retrieved from the Internet: URL: http://www.tektronik.com/ [retrieved on Jun. 13, 2008] section "Monitoring Multi-Channel Audio Signals," on p. 4; Section "Audio Compression" on pp. 17-18; section "Dolby Digital (AC-3) Vs. Dolby E".

Response to Written Opinion dated Mar. 18, 2016, from International Application No. PCT/US2015/047461, filed on Jun. 23, 2016, 5 pp.

Second Written Opinion from International Application No. PCT/US2015/047461, dated Sep. 6, 2016, 9 pp.

Invitation to Pay Additional Fees from International Application No. PCT/US2015/047461, dated Dec. 4, 2015, 8 pp.

Response to Invitation to Pay Additional Fees dated Dec. 4, 2015, from International Application No. PCT/US2015/047461, filed on Dec. 22, 2015, 3 pp.

International Preliminary Report on Patentability from International Application No. PCT/US2015/047461, dated Dec. 22, 2016, 11 pp.

Boehm, et al., "Proposed changes to the bitstream of RM0-HOA for integration of Qualcomm CE", MPEG Meeting; Jan. 2014; San Jose; (Motion Picture Expert Group or ISO/IECJTC1/SC29/WG11), No. m32246, XP030060698, 30 pp.

Krueger, et al., "Restriction of the Dynamic Range of HOA Coefficients in the HOA Input Format," MPEG Meeting; Jul. 7, 2014-Nov. 7, 2014; Sapporo; (Motion Picture Expert Group or ISO/IEC JTC1/SC29/WG11) No. m34239, Jul. 2014, XP030062612, 8 pp.

Boehm, et al., "Technical Description of the Technicolor Submission for the phase 2 CfP for 3D Audio," Mpeg Meeting; Jul. 2014; Sapporo; (Motion Picture Expert Group or ISO/IEC JTC1/SC29/WG11) No. m34237, XP030062610, 7 pp.

"Call for Proposals for 3D Audio," ISO/IEC JTC1/SC29/WG11/N13411, Jan. 2013, 20 pp.

Herre, et al., "MPEG-H 3D Audio—The New Standard for Coding of Immersive Spatial Audio," IEEE Journal of Selected Topics in Signal Processing, vol. 9, No. 5, Aug. 2015, pp. 770-779.

Poletti, "Three-Dimensional Surround Sound Systems Based on Spherical Harmonics," J. Audio Eng. Soc., vol. 53, No. 11, Nov. 2005, pp. 1004-1025.

"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.

"Information technology—High efficiency coding and media delivery in heterogeneous environments—Part 3: 3D Audio," ISO/IEC JTC 1/SC 29N, Apr. 4, 2014, 337 pp.

"Information technology—High efficiency coding and media delivery in heterogeneous environments—Part 3: 3D Audio," ISO/IEC JTC 1/SC 29, Jul. 25, 2014, 311 pp.

Hellerud, et al., "Encoding Higher Order Ambisonics with AAC," AES 124th Convention, May 17-20, 2008, 8 pp.

Sen, et al., "RM1-HOA Working Draft Text", MPEG Meeting; Jan. 2014; San Jose; (Motion Picture Expert Group or ISO/IEC JTC1/SC29/WG11), No. m31827, XP030060280, 83 pp.

Partial Search Report from International Application No. PCT/US2015/047461, dated Dec. 4, 2015, 8 pp.

DavidS, "What's all this talk about mezzanine," root6 blog, posted on Apr. 4, 2012 on http://www.root6.com/blog/index.php/2012/04/whats-all-this-talk-about-mezzanine/, 1 pp.

* cited by examiner

INTERMEDIATE COMPRESSION FOR HIGHER ORDER AMBISONIC AUDIO DATA

This application claims the benefit of the following U.S. Provisional Applications:

U.S. Provisional Application No. 62/043,987, filed Aug. 29, 2014, entitled "MEZZANINE COMPRESSION FOR HIGHER ORDER AMBISONIC AUDIO DATA;"

U.S. Provisional Application No. 62/145,402, filed Apr. 9, 2015, entitled "MEZZANINE COMPRESSION FOR HIGHER ORDER AMBISONIC AUDIO DATA;" and U.S. Provisional Application No. 62/146,115, Apr. 10, 2015, entitled "MEZZANINE COMPRESSION FOR HIGHER ORDER AMBISONIC AUDIO DATA,"

the entire content of each of which are incorporated herein by reference.

TECHNICAL FIELD

This disclosure relates to audio data and, more specifically, compression of audio data.

BACKGROUND

A higher order ambisonics (HOA) signal (often represented by a plurality of spherical harmonic coefficients (SHC) or other hierarchical elements) is a three-dimensional (3D) representation of a soundfield. The HOA or SHC representation may represent this soundfield in a manner that is independent of the local speaker geometry used to playback a multi-channel audio signal rendered from this SHC signal. The SHC signal may also facilitate backwards compatibility as the SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for mezzanine compression of higher order ambisonics audio data. Higher order ambisonics audio data may comprise at least one spherical harmonic coefficient corresponding to a spherical harmonic basis function having an order greater than one and, in some examples, a plurality of spherical harmonic coefficients corresponding multiple spherical harmonic basis functions having an order greater than one.

In one example, a device comprises a memory configured to store an intermediately formatted audio data generated as a result of an intermediate compression of higher order ambisonic audio data, and one or more processors configured to process the intermediately formatted audio data.

In another example, a method comprises obtaining, by a broadcasting network, intermediately formatted audio data generated as a result of an intermediate compression of higher order ambisonic audio data, and processing, by the broadcasting network, the intermediately formatted audio data.

In another example, a non-transitory computer-readable storage medium having stored thereon instructions that, when executed, cause one or more processors to obtain intermediately formatted audio data generated as a result of an intermediate compression of higher order ambisonic audio data, and process the intermediately formatted audio data.

In another example, a device comprises a memory configured to store higher order ambisonic audio data, and one or more processors configured to perform intermediate compression with respect to the higher order ambisonic audio data to obtain intermediately formatted audio data.

The details of one or more aspects of the techniques are set forth in the accompanying drawings and the description below. Other features, objects, and advantages of these techniques will be apparent from the description and drawings, and from the claims.

DETAILED DESCRIPTION

Figure 1:
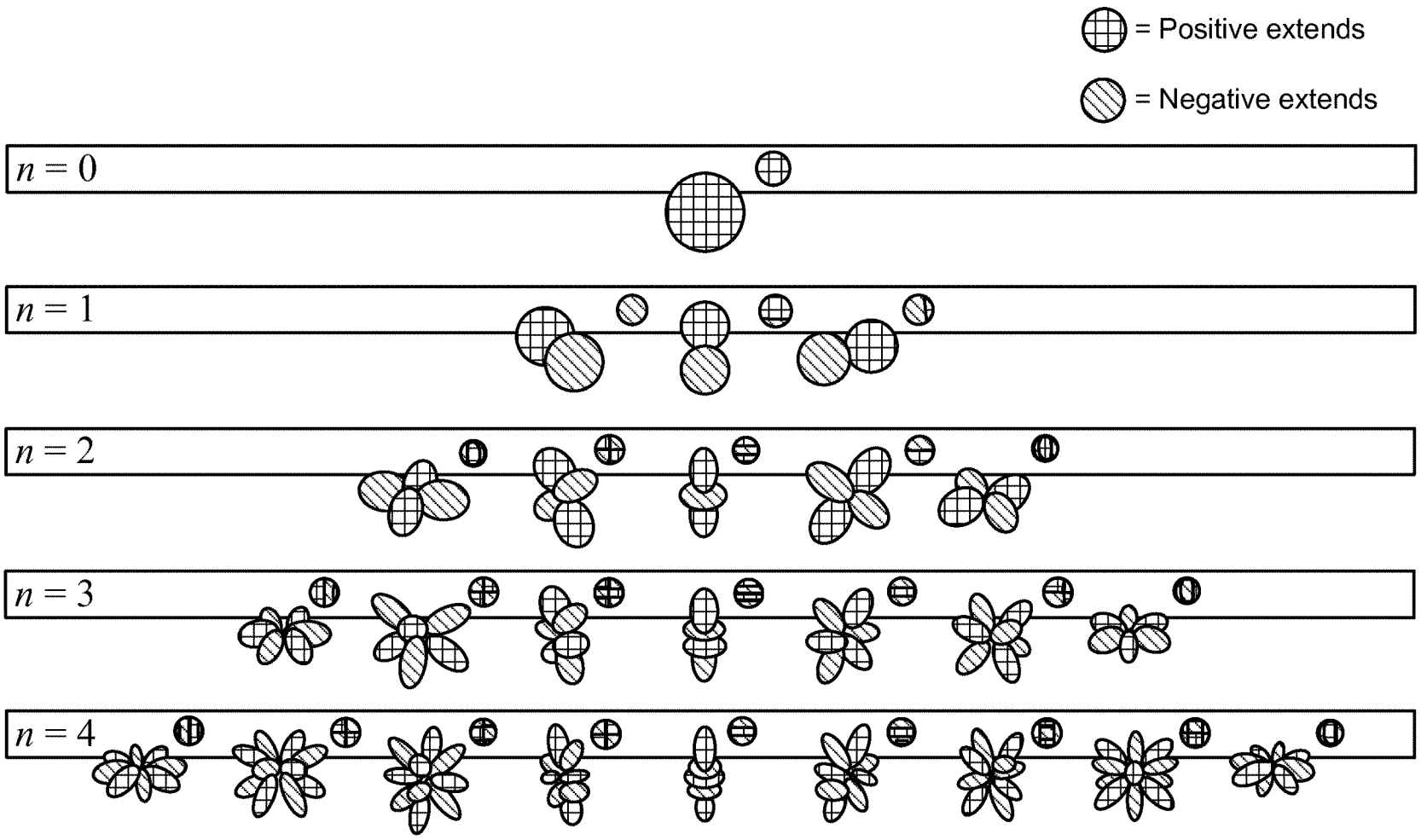
FIG. 1 is a diagram illustrating spherical harmonic basis functions of various orders and sub-orders.

The evolution of surround sound has made available many output formats for entertainment. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on coordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients"). A future MPEG encoder is described in more detail in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \phi_r\}$ of the soundfield, at time t, can be represented uniquely by the SHC, $A_n^m(k)$. Here, $$k = \frac{\omega}{c},$$

c is the speed of sound (~343 m/s), $\{r_r, \theta_r, \phi_r\}$ is a point of reference (or observation point), $j_n(\bullet)$ is the spherical Bessel function of order n, and $Y_n^m(\theta_r, \phi_r)$ are the spherical harmonic basis functions of order n and suborder m. It can be recognized that the term in square brackets is a frequency-domain representation of the signal (i.e., $S(\omega, r_r, \theta_r, \phi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\phi_s),$$

where i is $\sqrt{-1}$, $h_n^{(2)}(\bullet)$ is the spherical Hankel function (of the second kind) of order n, and $\{r_s, \theta_s, \phi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \phi_r\}$. The remaining figures are described below in the context of object-based and SHC-based audio coding.

Figure 2:
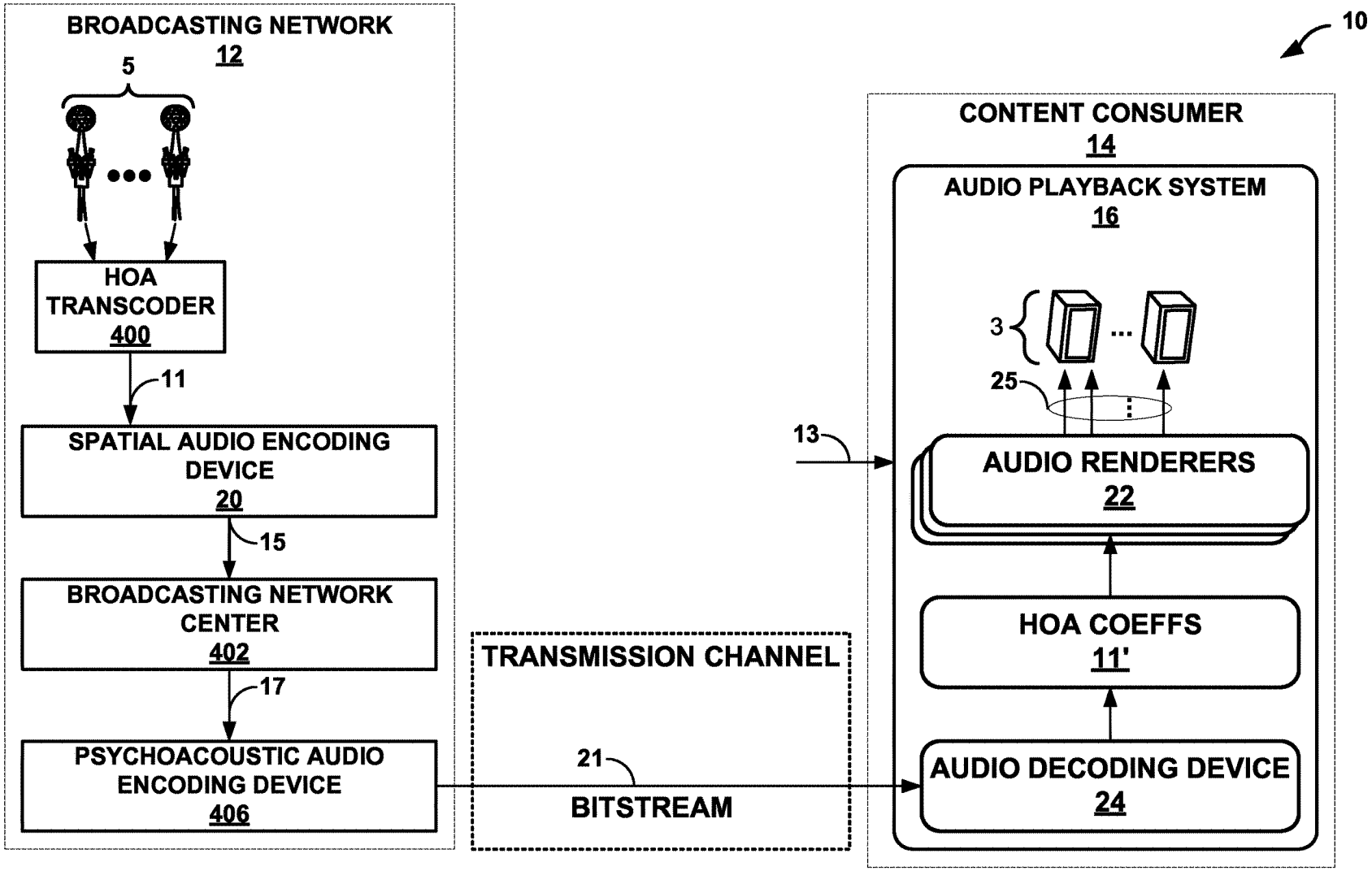
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a broadcasting network 12 and a content consumer 14. While described in the context of the broadcasting network 12 and the content consumer 14, the techniques may be implemented in any context in which SHCs (which may also be referred to as HOA coefficients) or any other hierarchical representation of a soundfield are encoded to form a bitstream representative of the audio data. Moreover, the broadcasting network 12 may represent a system comprising one or more of any form of computing devices capable of implementing the techniques described in this disclosure, including a handset (or cellular phone), a tablet computer, a smart phone, a laptop computer, a desktop computer, or dedicated hardware to provide a few examples or. Likewise, the content consumer 14 may represent any form of computing device capable of implementing the techniques described in this disclosure, including a handset (or cellular phone), a tablet computer, a smart phone, a television, a set-top box, a laptop computer, or a desktop computer to provide a few examples.

The broadcasting network 12 may represent any entity that may generate multi-channel audio content and possibly video content for consumption by content consumers, such as the content consumer 14. The broadcasting network 12 may capture live audio data at events, such as sporting events, while also inserting various other types of additional audio data, such as commentary audio data, commercial audio data, intro or exit audio data and the like, into the live audio content.

The content consumer 14 represents an individual that owns or has access to an audio playback system, which may refer to any form of audio playback system capable of rendering higher order ambisonic audio data (which includes higher order audio coefficients that may also be referred to as spherical harmonic coefficients) for play back as multi-channel audio content. In the example of FIG. 2, the content consumer 14 includes an audio playback system 16.

The broadcasting network 12 includes microphones 5 that record or otherwise obtain live recordings in various formats (including directly as HOA coefficients) and audio objects. When the microphones 5 obtain live audio directly as HOA coefficients, the microphones 5 may include an HOA transcoder, such as an HOA transcoder 400 shown in the example of FIG. 2. In other words, although shown as separate from the microphones 5, a separate instance of the HOA transcoder 400 may be included within each of the microphones 5 so as to naturally transcode the captured feeds into the HOA coefficients 11. However, when not included within the microphones 5, the HOA transcoder 400 may transcode the live feeds output from the microphones 5 into the HOA coefficients 11. In this respect, the HOA transcoder 400 may represent a unit configured to transcode microphone feeds and/or audio objects into the HOA coefficients 11. The broadcasting network 12 therefore includes the HOA transcoder 400 as integrated with the microphones 5, as an HOA transcoder separate from the microphones 5 or some combination thereof.

The broadcasting network 12 may also include a spatial audio encoding device 20, a broadcasting network center 402 and a psychoacoustic audio encoding device 406. The spatial audio encoding device 20 may represent a device capable of performing the mezzanine compression techniques described in this disclosure with respect to the HOA coefficients 11 to obtain intermediately formatted audio data 15 (which may also be referred to as "mezzanine formatted audio data 15"). Although described in more detail below, the spatial audio encoding device 20 may be configured to perform this intermediate compression (which may also be referred to as "mezzanine compression") with respect to the HOA coefficients 11 by performing, at least in part, a decomposition (such as a linear decomposition described in more detail below) with respect to the HOA coefficients 11.

The spatial audio encoding device 20 may be configured to encode the HOA coefficients 11 using a decomposition involving application of a linear invertible transform (LIT). One example of the linear invertible transform is referred to as a "singular value decomposition" (or "SVD"), which may represent one form of a linear decomposition. In this example, the spatial audio encoding device 20 may apply SVD to the HOA coefficients 11 to determine a decomposed version of the HOA coefficients 11. The spatial audio encoding device 20 may then analyze the decomposed version of the HOA coefficients 11 to identify various parameters, which may facilitate reordering of the decomposed version of the HOA coefficients 11.

The spatial audio encoding device 20 may reorder the decomposed version of the HOA coefficients 11 based on the identified parameters, where such reordering, as described in further detail below, may improve coding efficiency given that the transformation may reorder the HOA coefficients across frames of the HOA coefficients (where a frame commonly includes M samples of the HOA coefficients 11 and M is, in some examples, set to 1024). After reordering the decomposed version of the HOA coefficients 11, the spatial audio encoding device 20 may select those of the decomposed version of the HOA coefficients 11 representative of foreground (or, in other words, distinct, predominant or salient) components of the soundfield. The spatial audio encoding device 20 may specify the decomposed version of the HOA coefficients 11 representative of the foreground components as an audio object and associated directional information.

The spatial audio encoding device 20 may also perform a soundfield analysis with respect to the HOA coefficients 11 in order, at least in part, to identify the HOA coefficients 11 representative of one or more background (or, in other words, ambient) components of the soundfield. The spatial audio encoding device 20 may perform energy compensation with respect to the background components given that, in some examples, the background components may only include a subset of any given sample of the HOA coefficients 11 (e.g., such as those corresponding to zero and first order spherical basis functions and not those corresponding to second or higher order spherical basis functions). When order-reduction is performed, in other words, the spatial audio encoding device 20 may augment (e.g., add/subtract energy to/from) the remaining background HOA coefficients of the HOA coefficients 11 to compensate for the change in overall energy that results from performing the order reduction.

The spatial audio encoding device 20 may perform a form of interpolation with respect to the foreground directional information and then perform an order reduction with respect to the interpolated foreground directional information to generate order reduced foreground directional information. The spatial audio encoding device 20 may further perform, in some examples, a quantization with respect to the order reduced foreground directional information, outputting coded foreground directional information. In some instances, this quantization may comprise a scalar/entropy quantization. The spatial audio encoding device 20 may then output the mezzanine formatted audio data 15 as the background components, the foreground audio objects, and the quantized directional information. The background components and the foreground audio objects may comprise pulse code modulated (PCM) transport channels in some examples.

The spatial audio encoding device 20 may then transmit or otherwise output the mezzanine formatted audio data 15 to the broadcasting network center 402. Although not shown in the example of FIG. 2, further processing of the mezzanine formatted audio data 15 may be performed to accommodate transmission from the spatial audio encoding device 20 to the broadcasting network center 402 (such as encryption, satellite compression schemes, fiber compression schemes, etc.).

Mezzanine formatted audio data 15 may represent audio data that conforms to a so-called mezzanine format, which is typically a lightly compressed (relative to end-user compression provided through application of psychoacoustic audio encoding to audio data, such as MPEG surround, MPEG-AAC, MPEG-USAC or other known forms of psychoacoustic encoding) version of the audio data. Given that broadcasters prefer dedicated equipment that provides low latency mixing, editing, and other audio and/or video functions, broadcasters are reluctant to upgrade the equipment given the cost of such dedicated equipment.

To accommodate the increasing bitrates of video and/or audio and provide interoperability with older or, in other words, legacy equipment that may not be adapted to work on high definition video content or 3D audio content, broadcasters have employed this intermediate compression scheme, which is generally referred to as "mezzanine compression," to reduce file sizes and thereby facilitate transfer times (such as over a network or between devices) and improved processing (especially for older legacy equipment). In other words, this mezzanine compression may provide a more lightweight version of the content which may be used to facilitate editing times, reduce latency and potentially improve the overall broadcasting process.

The broadcasting network center 402 may therefore represent a system responsible for editing and otherwise processing audio and/or video content using an intermediate compression scheme to improve the work flow in terms of latency. The broadcasting network center 402 may, in some examples, include a collection of mobile devices. In the context of processing audio data, the broadcasting network center 402 may, in some examples, insert intermediately formatted additional audio data into the live audio content represented by the mezzanine formatted audio data 15. This additional audio data may comprise commercial audio data representative of commercial audio content (including audio content for television commercials), television studio show audio data representative of television studio audio content, intro audio data representative of intro audio content, exit audio data representative of exit audio content, emergency audio data representative of emergency audio content (e.g., weather warnings, national emergencies, local emergencies, etc.) or any other type of audio data that may be inserted into mezzanine formatted audio data 15.

In some examples, the broadcasting network center 402 includes legacy audio equipment capable of processing up to 16 audio channels. In the context of 3D audio data that relies on HOA coefficients, such as the HOA coefficients 11, the HOA coefficients 11 may have more than 16 audio channels (e.g., a $4^{th}$ order representation of the 3D soundfield would require $(4+1)^2$ or 25 HOA coefficients per sample, which is equivalent to 25 audio channels). This limitation in legacy broadcasting equipment may slow adoption of 3D HOA-based audio formats, such as that set forth in the ISO/IEC DIS 23008-3 document, entitled "Information technology—High efficiency coding and media delivery in heterogeneous environments—Part 3: 3D audio," by ISO/IEC JTC 1/SC 29/WG 11, dated Jul. 25, 2014.

As such, the techniques described in this disclosure may promote a form of mezzanine compression that allows for obtaining the mezzanine formatted audio data 15 from the HOA coefficients 11 in a manner that overcomes the channel-based limitations of legacy audio equipment. That is, the spatial audio encoding device 20 may be configured to perform the techniques described in this disclosure to obtain the mezzanine audio data 15 having 16 or fewer audio channels (and possibly as few as 6 audio channels given that legacy audio equipment may, in some examples, allow for processing 5.1 audio content, where the '0.1' represents the sixth audio channel).

In any event, the broadcasting network center 402 may output updated mezzanine formatted audio data 17. The updated mezzanine formatted audio data 17 may include the mezzanine formatted audio data 15 and any additional audio data inserted into the mezzanine formatted audio data 15 by the broadcasting network center 404. Prior to distribution, the broadcasting network 12 may further compress the updated mezzanine formatted audio data 17. As shown in the example of FIG. 2, the psychoacoustic audio encoding device 406 may perform psychoacoustic audio encoding (e.g., any one of the examples described above) with respect to the updated mezzanine formatted audio data 17 to generate a bitstream 21. The broadcasting network 12 may then transmit the bitstream 21 via a transmission channel to the content consumer 14.

In some examples, the psychoacoustic audio encoding device 406 may represent multiple instances of a psychoacoustic audio coder, each of which is used to encode a different audio object or HOA channel of each of updated mezzanine formatted audio data 17. In some instances, this psychoacoustic audio encoding device 406 may represent one or more instances of an advanced audio coding (AAC) encoding unit. Often, the psychoacoustic audio coder unit 40 may invoke an instance of an AAC encoding unit for each of channel of the updated mezzanine formatted audio data 17.

More information regarding how the background spherical harmonic coefficients may be encoded using an AAC encoding unit can be found in a convention paper by Eric Hellerud, et al., entitled "Encoding Higher Order Ambisonics with AAC," presented at the $124^{th}$ Convention, 2008 May 17-20 and available at: http://ro.uow.edu.au/cgi/viewcontent.cgi?article=8025&context=engpapers. In some instances, the psychoacoustic audio encoding device 406 may audio encode various channels (e.g., background channels) of the updated mezzanine formatted audio data 17 using a lower target bitrate than that used to encode other channels (e.g., foreground channels) of the updated mezzanine formatted audio data 17.

While shown in FIG. 2 as being directly transmitted to the content consumer 14, the broadcasting network 12 may output the bitstream 21 to an intermediate device positioned between the broadcasting network 12 and the content consumer 14. The intermediate device may store the bitstream 21 for later delivery to the content consumer 14, which may request this bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer 14, requesting the bitstream 21.

Alternatively, the broadcasting network 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to those channels by which content stored to these mediums are transmitted (and may include retail stores and other store-based delivery mechanism). In any event, the techniques of this disclosure should not therefore be limited in this respect to the example of FIG. 2.

As further shown in the example of FIG. 2, the content consumer 14 includes the audio playback system 16. The audio playback system 16 may represent any audio playback system capable of playing back multi-channel audio data. The audio playback system 16 may include a number of different audio renderers 22. The audio renderers 22 may each provide for a different form of rendering, where the different forms of rendering may include one or more of the various ways of performing vector-base amplitude panning (VBAP), and/or one or more of the various ways of performing soundfield synthesis.

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel. That is, the audio decoding device 24 may dequantize the foreground directional information specified in the bitstream 21, while also performing psychoacoustic decoding with respect to the foreground audio objects specified in the bitstream 21 and the encoded HOA coefficients representative of background components. The audio decoding device 24 may further perform interpolation with respect to the decoded foreground directional information and then determine the HOA coefficients representative of the foreground components based on the decoded foreground audio objects and the interpolated foreground directional information. The audio decoding device 24 may then determine the HOA coefficients 11' based on the determined HOA coefficients representative of the foreground components and the decoded HOA coefficients representative of the background components.

The audio playback system 16 may, after decoding the bitstream 21 to obtain the HOA coefficients 11', render the HOA coefficients 11' to output loudspeaker feeds 25. The loudspeaker feeds 25 may drive one or more loudspeakers 3.

To select the appropriate renderer or, in some instances, generate an appropriate renderer, the audio playback system 16 may obtain loudspeaker information 13 indicative of a number of the loudspeakers 3 and/or a spatial geometry of the loudspeakers 3. In some instances, the audio playback system 16 may obtain the loudspeaker information 13 using a reference microphone and driving the loudspeakers 3 in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may select one of the audio renderers 22 based on the loudspeaker information 13. In some instances, the audio playback system 16 may, when none of the audio renderers 22 are within some threshold similarity measure (in terms of the loudspeaker geometry) to that specified in the loudspeaker information 13, generate the one of audio renderers 22 based on the loudspeaker information 13. The audio playback system 16 may, in some instances, generate the one of audio renderers 22 based on the loudspeaker information 13 without first attempting to select an existing one of the audio renderers 22.

Figure 3A:
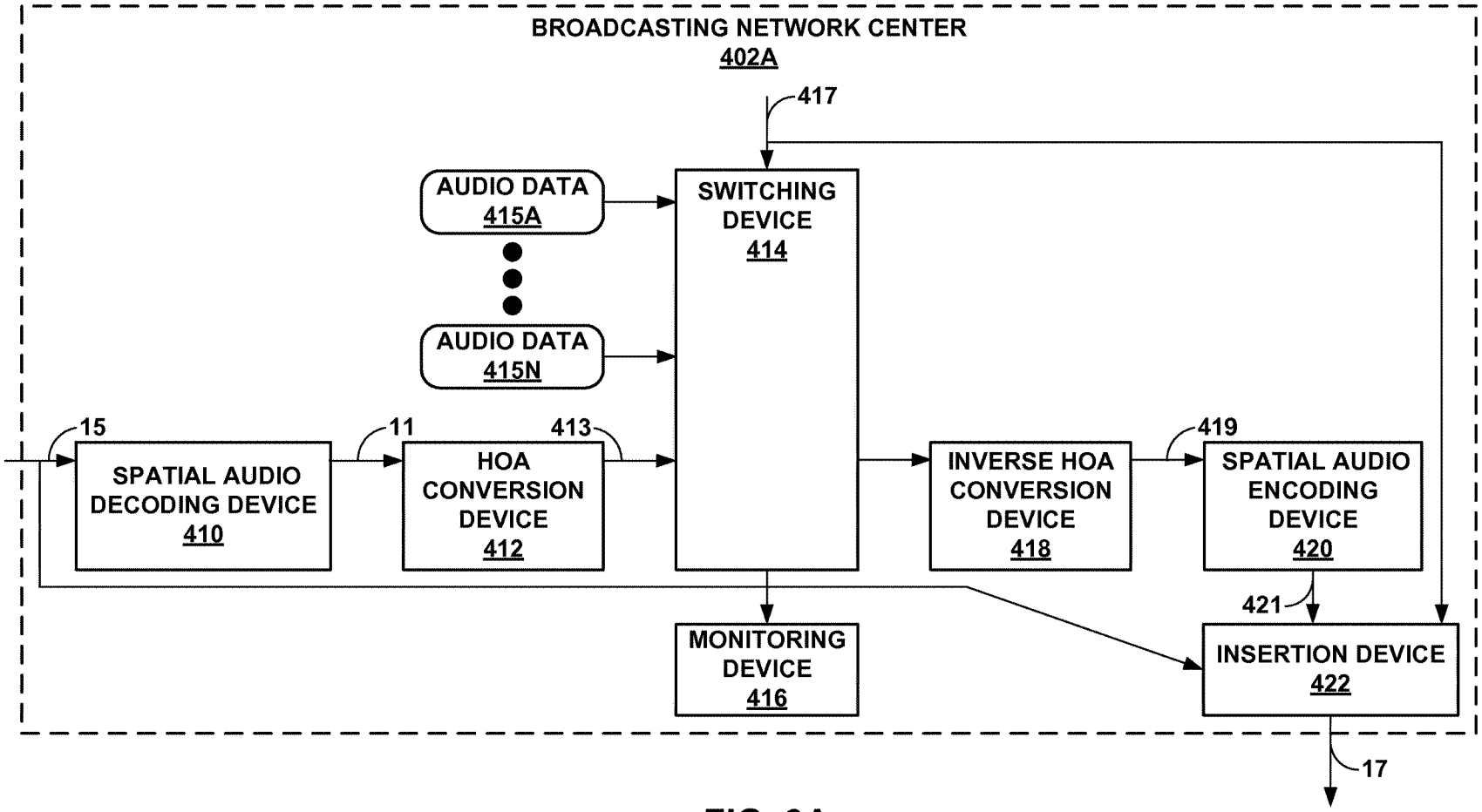
FIGS. 3A-3C are diagrams illustrating a broadcasting network center of FIG. 2 in more detail.
Figure 3B:
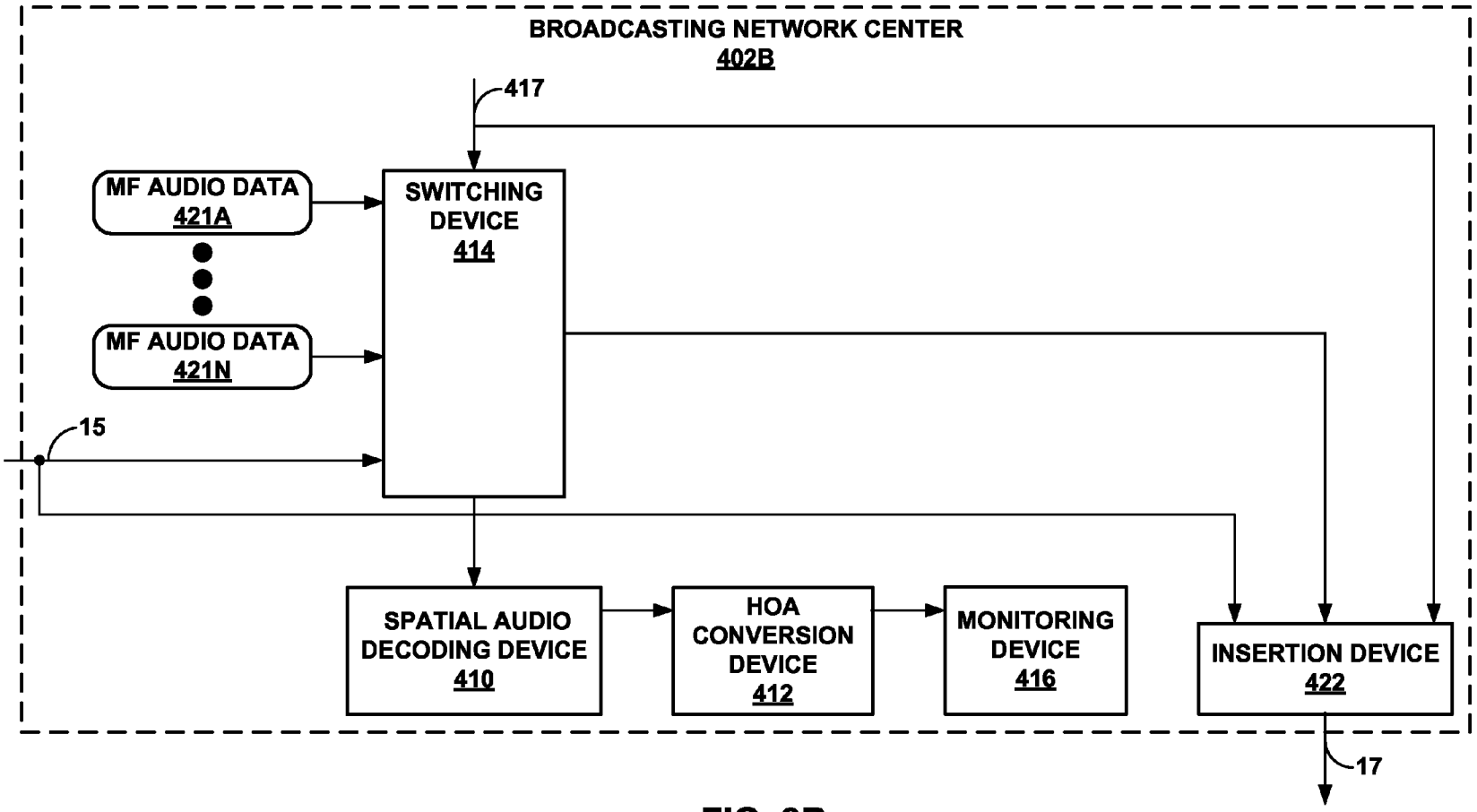
Figure 3C:
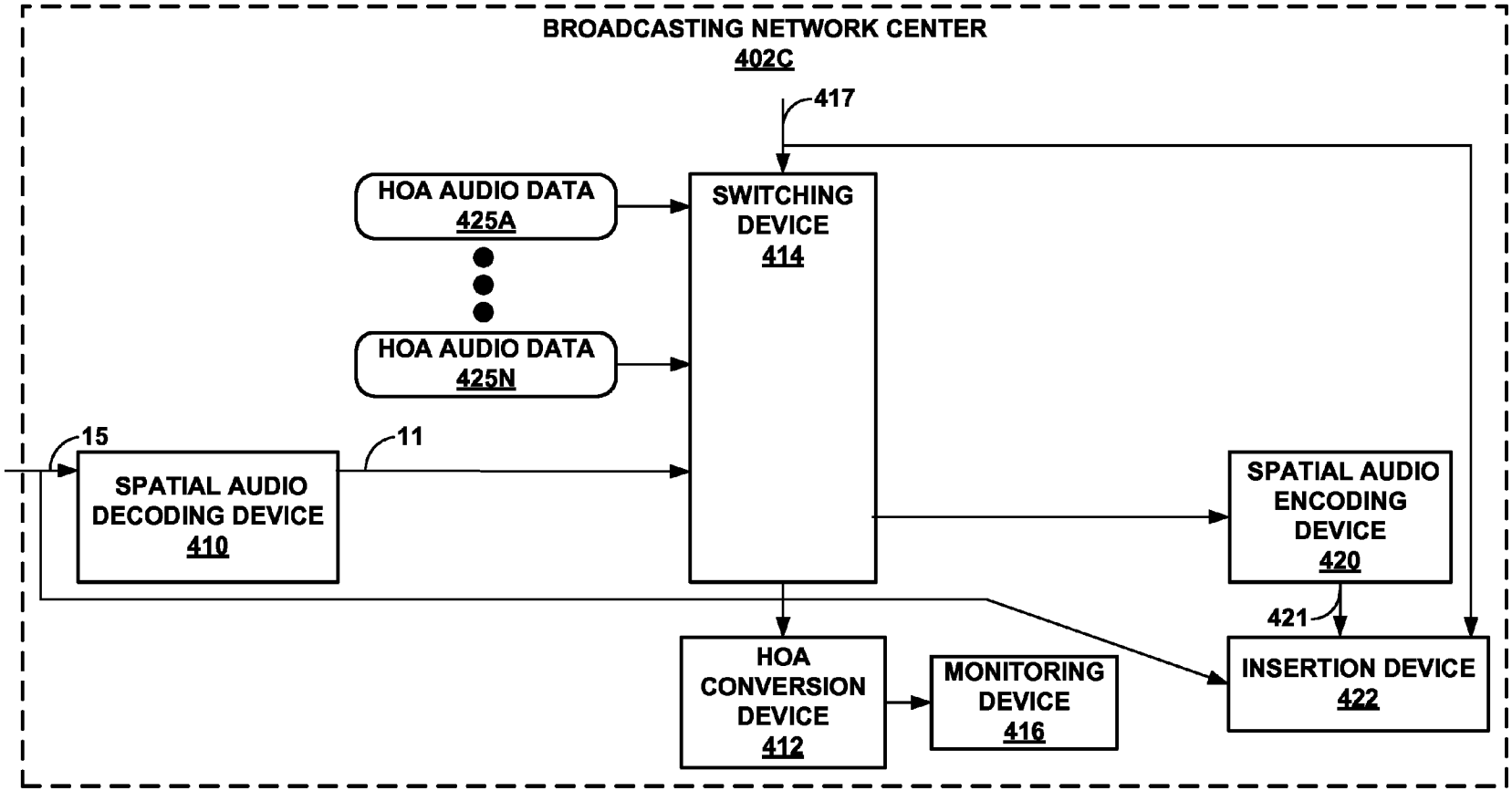

FIGS. 3A-3C are diagrams illustrating, in more detail, three different examples of the broadcasting network center 402 of FIG. 2. In the example of FIG. 3A, the first example of the broadcasting network center 402, which is denoted broadcasting network center 402A, includes a spatial audio decoding device 410, an HOA conversion device 412, a switching device 414, a monitoring device 416, an inverse HOA conversion device 418, a spatial audio encoding device 420 and an insertion device 422.

Figure 6:
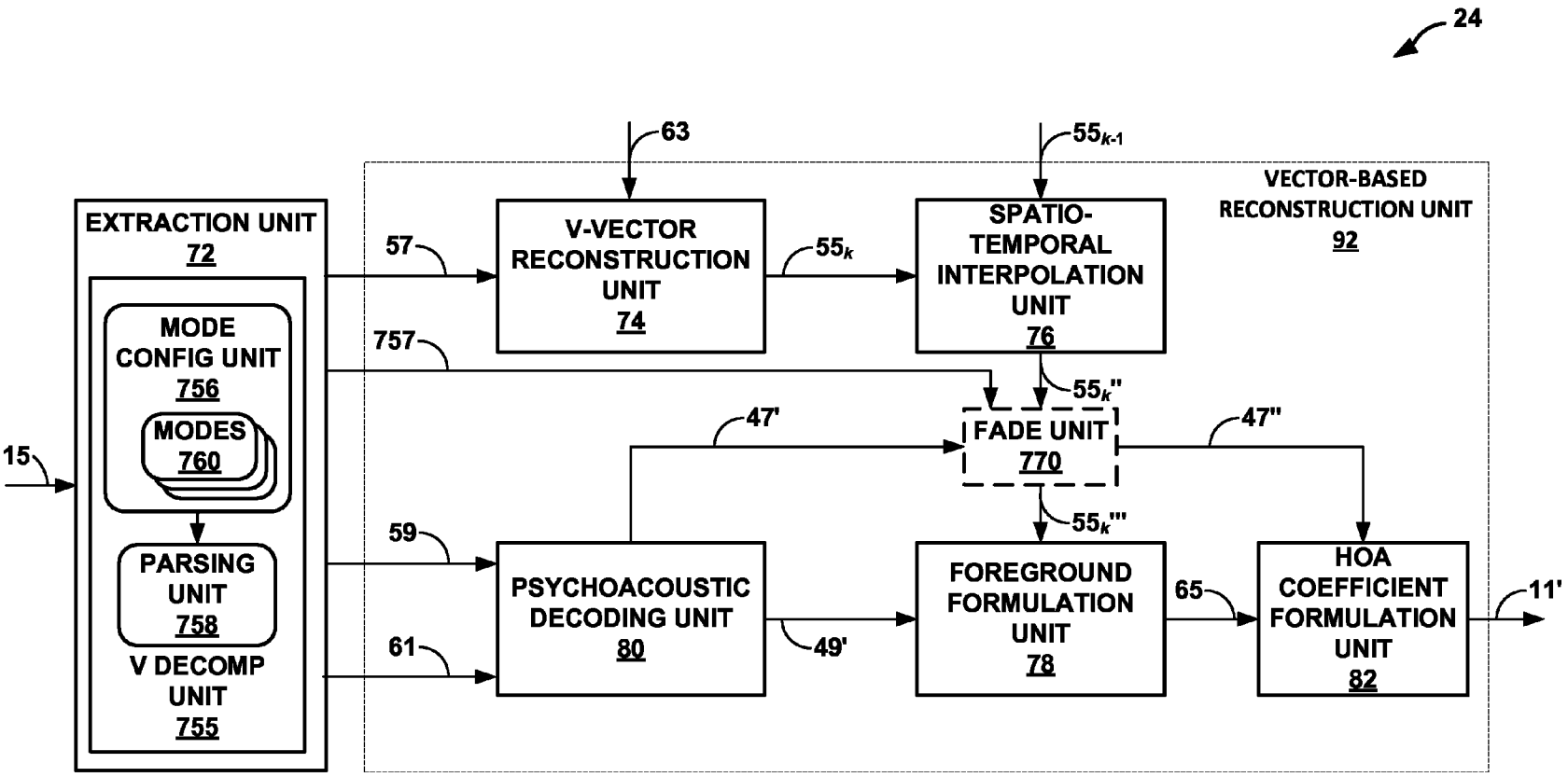
FIG. 6 is a block diagram illustrating the audio decoding device of FIG. 2 in more detail.

The spatial audio decoding device 410, which is described in more detail with respect to FIG. 6, represents a device or unit configured to perform operations generally reciprocal of those described with respect to the spatial audio encoding device 20. The spatial audio decoding device 410 may, in other words, obtain mezzanine formatted audio data 15 and perform mezzanine decompression with respect to the mezzanine formatted audio data 15 to obtain the HOA coefficients 11. The spatial audio decoding device 410 may output the HOA coefficients 11 to the HOA conversion device 412.

The HOA conversion device 412 represents a device or unit configured to convert the HOA coefficients 11 from the spherical harmonic domain to a spatial domain (e.g. by rendering the HOA coefficients 11 to a specified spatial sound format, such as a 5.1 surround sound format). The HOA conversion device 412 may perform this conversion to accommodate the legacy audio equipment, such as the switching device 414 and the monitoring device 416 (both or one of which may be configured to operate with respect to a certain number of channels, such as the 6 channels of a 5.1 surround sound format). The HOA conversion device 412 may output spatial formatted audio data 413 to the switching device 414.

The switching device 414 may represent a device or unit configured to switch between various different audio data, including the spatial formatted audio data 413. The switching device 414 may switch between additional audio data 415A-415N ("additional audio data 415," which may also be referred to as "audio data 415" as shown in the example of FIG. 3A) and the spatial formatted audio data 413. The additional audio data 415 may also be referred to as "network center content 415" or "network center audio content 415."

The switching device 414 may switch between the audio data 415 and the spatial formatted audio data 415 as instructed by an input 417, which may be input by an operator, audio editor or other broadcaster personnel. The input 417 may configure the switching device 414 to output one of the audio data 415 or the spatial formatted audio data 413 to monitoring device 416. The operator, audio editor or other broadcasting personnel may listen to the selected one of the audio data 415 or the spatial formatted audio data 413 and generate additional input 417 specifying when one of the additional audio data 415 should be inserted into the mezzanine formatted audio data 15.

Upon receiving the additional input 417, the switching device 414 may switch through the selected one of the additional audio data 415, e.g., additional audio data 415A, through to the inverse HOA conversion device 418. This additional audio data 415A may represent any of the above discussed types of additional audio content, such as commercial audio content, television studio audio content, exit audio content, intro audio content (where intro and exit audio content may be referred to as "bumper audio content"), emergency audio content and the like.

The additional audio data 415A (and generally the additional audio content 415) is not, in some examples, specified in either the mezzanine format or the spherical harmonic or, in other words, HOA domain. Instead, the additional audio data 415 may be specified the 5.1 surround sound format. To insert the additional audio data 415A into the mezzanine formatted spatial audio data 15, the broadcasting network center 402A may pass the additional audio data 415A to the inverse HOA conversion device 418.

The inverse HOA conversion device 418 may operate reciprocally to the HOA conversion device 412 to convert the additional audio data 415A from the spatial domain to the spherical harmonic domain. The inverse HOA conversion device 418 may output the converted additional audio data 415A as converted additional audio data 419 to the spatial audio encoding device 420. The spatial audio encoding device 420 may operate in a manner substantially similar to and possibly the same as that described above with respect to spatial audio encoding device 20. The spatial audio encoding device 420 may output mezzanine formatted additional audio data 421 to the insertion device 422.

The insertion device 422 may represent a device or unit configured to insert the mezzanine formatted additional audio data 421 into the mezzanine formatted audio data 15. In some examples, the insertion device 422 inserts mezzanine formatted additional audio data 421 into the original mezzanine formatted audio data 15, where the original mezzanine formatted audio data 15 has not undergone spatial audio decoding (or, in other words, mezzanine decompression), HOA conversion, spatial audio re-encoding and inverse HOA conversion, so as to avoid potential injection of audio artifacts into the updated mezzanine formatted audio data 17. The insertion device 422 may insert the mezzanine formatted audio data 421 into the mezzanine formatted audio data 15 by, at least in part, fading (including, in some examples, crossfading) the mezzanine formatted audio data 421 into the mezzanine formatted audio data 15. Crossfading may refer to fading first audio data in while fading second (different) audio data out.

FIG. 3B is a block diagram illustrating, in more detail, a second example of the broadcasting network center 402 of FIG. 2. In the example of FIG. 3B, the second example of the broadcasting network center 402, which is denoted broadcasting network center 402B, may be substantially the same as the broadcasting network center 402A, except that the additional audio data 421A-421N shown in the example of FIG. 3B is already specified in the mezzanine format (MF). As such, the additional audio data 421A-421N is denoted as mezzanine formatted (MF) audio data 421A-421N ("MF audio data 425") in the example of FIG. 3B. The MF audio data 421 may each be substantially similar to the mezzanine formatted additional audio data 421 described above with respect to the example of FIG. 3A.

Although not shown in the example of FIG. 3B, the broadcasting network center 402B may include one or more devices to originally obtain the additional audio data in the form of audio data specified in the spatial domain and convert the additional audio data from the spatial domain to the spherical harmonic domain such that the soundfield described by the additional audio data is representated as additional higher order ambisonic audio data. The broadcast network center 402B may further include one or more devices (which may be the same one or more devices referenced above) to perform the intermediate compression (or in other words, mezzanine compression) with respect to the additional higher order ambisonic audio data to generate intermediately formatted additional audio data (e.g., MF audio data 421).

Given that the MF audio data 425 is specified in accordance with the mezzanine format, the broadcasting network center 402B may not include the inverse HOA conversion device 418 and the spatial audio encoding device 420 described above with respect to the broadcasting network center 402A. Because all of the audio data 421 and 15 input into the switching device 414 is specified in the same format (e.g., mezzanine format) no spatial audio decoding and conversion may be required prior to processing by switching device 417.

To monitor the MF additional audio data 421 and the MF audio data 15, the broadcasting network center 402B may include the spatial audio decoding device 410 and the HOA conversion device 412 to perform spatial audio decoding and HOA conversion with respect to the outputs of the switching device 414. The spatial audio decoding and HOA conversion may result in audio data specified in the spatial domain (e.g., 5.1 audio data) that is then input to the monitoring device 416 to allow an operator, editor or other broadcasting personnel to monitor the selected one (as specified by input data 417) of the inputs to the switching device 414. The spatial domain may also be referred to as a "channel domain."

In this respect, the broadcasting network center 402B may process the intermediately formatted audio data (or, in other words, the mezzanine formatted audio data) without performing either of an intermediate decompression (or, in other words, the mezzanine decompression) or higher order ambisonic conversion with respect to the intermediately formatted audio data.

FIG. 3C is a block diagram illustrating, in more detail, a third example of the broadcasting network center 402 of FIG. 2. In the example of FIG. 3C, the third example of the broadcasting network center 402, which is denoted broadcasting network center 402C, may be substantially similar to the broadcasting network center 402B, except that the additional audio data 425A-425N shown in the example of FIG. 3C is specified in the HOA format (or, in other words, in the spherical harmonic domain). As such, the additional audio data 425A-425N is denoted as HOA audio data 425A-425N ("HOA audio data 425") in the example of FIG. 3C.

Given that the HOA audio data 425 is specified in accordance with the HOA format, the broadcasting network center 402C may not include the inverse HOA conversion device 418. However, the broadcasting network center 402C may include the spatial audio encoding device 420 described above with respect to the broadcasting network center 402A so as to perform mezzanine compression with respect to the HOA audio data 425 to obtain MF additional audio data 421. Because the audio data 425 is specified in the HOA domain (or, in other words, the spherical harmonic domain), the spatial audio decoding device 410 performs spatial audio decoding with respect to the mezzanine formatted audio data 15 to obtain the HOA coefficients 11, thereby potentially harmonizing the input format into switching device 414.

To monitor the HOA audio data 421 and 11, the broadcasting network center 402C may include the HOA conversion device 412 to perform HOA conversion with respect to the outputs of the switching device 414. The HOA conversion may result in audio data specified in the spatial domain (e.g., 5.1 audio data) that is then input to the monitoring device 416 to allow an operator, editor or other broadcasting personnel to monitor the selected one (as specified by input data 417) of the inputs to the switching device 414.

Figure 4:
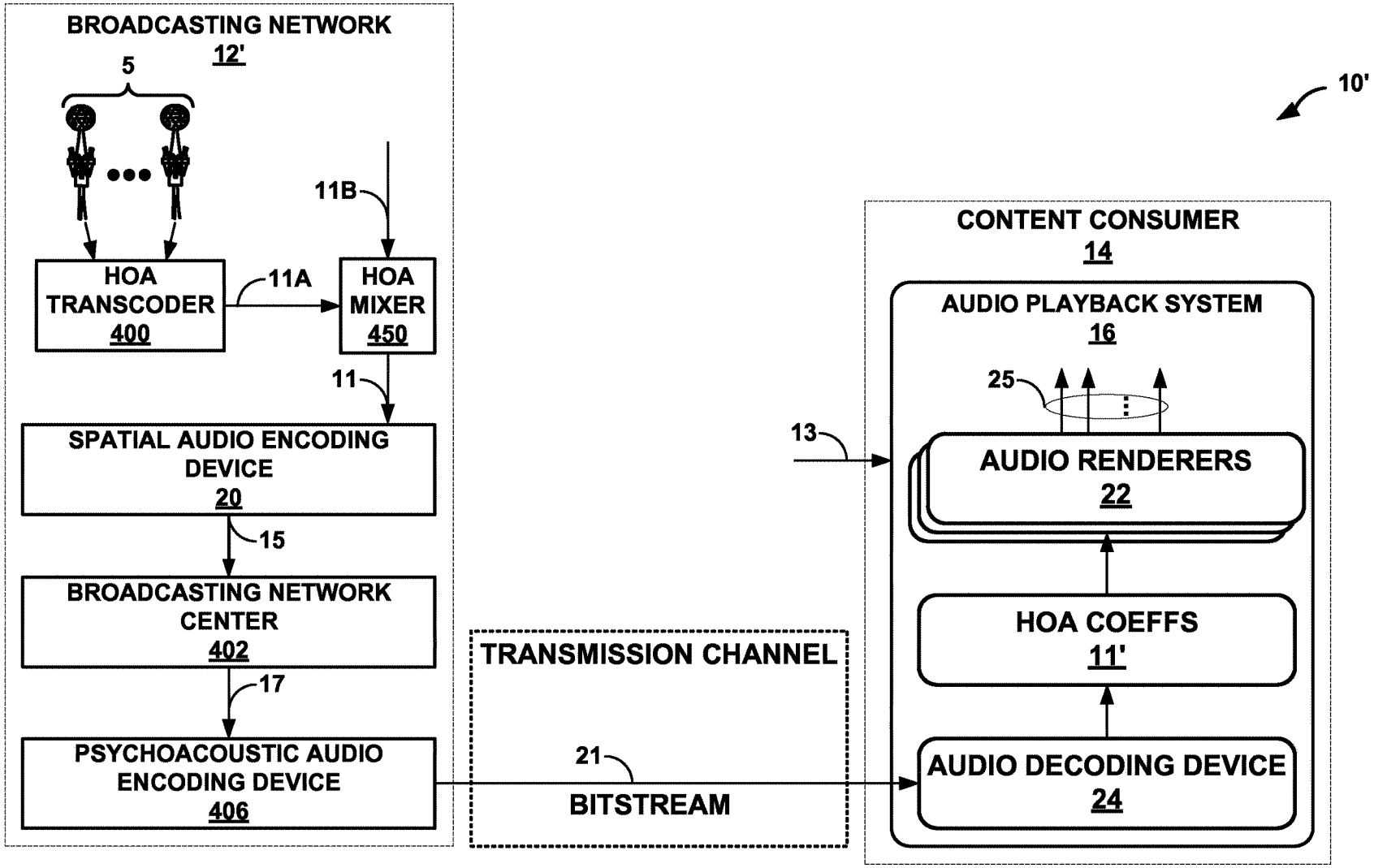
FIG. 4 is a block diagram illustrating a different example of the system shown in the example of FIG. 2.

FIG. 4 is a block diagram illustrating another example of a system that may be configured to perform various aspects of the techniques described in this disclosure. The system shown in FIG. 4 is similar to system 10 of FIG. 2 except that the broadcasting network 12 includes an additional HOA mixer 450. As such, the system shown in FIG. 4 is denoted as system 10' and the broadcast network of FIG. 4 is denoted as broadcast network 12'. The HOA transcoder 400 may output the live feed HOA coefficients as HOA coefficients 11A to the HOA mixer 450. The HOA mixer represents a device or unit configured to mix HOA audio data. HOA mixer 450 may receive other HOA audio data 11B (which may be representative of any other type of audio data, including audio data captured with spot microphones or non-3D microphones and converted to the spherical harmonic domain, special effects specified in the HOA domain, etc.) and mix this HOA audio data 11B with HOA audio data 11A to obtain HOA coefficients 11.

Figure 5:
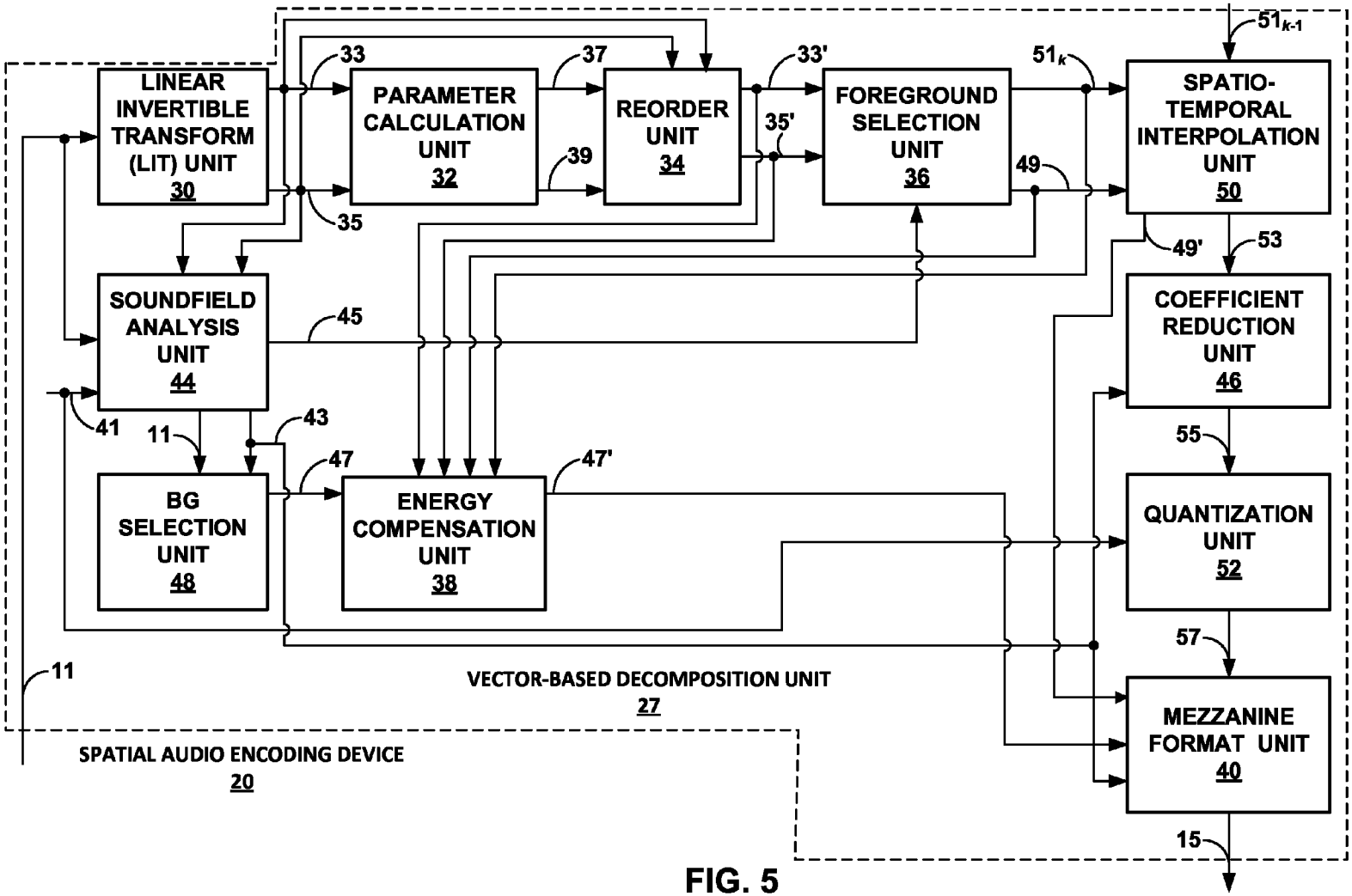
FIG. 5 is a block diagram illustrating, in more detail, one example of the spatial audio encoding device shown in the example of FIG. 2 that may perform various aspects of the techniques described in this disclosure.

FIG. 5 is a block diagram illustrating, in more detail, one example of the spatial audio encoding device 20 shown in the example of FIG. 2 that may perform various aspects of the techniques described in this disclosure. The spatial audio encoding device 20 includes a vector-based decomposition unit 27.

Although described briefly below, more information regarding the vector-based decomposition unit 27 and the various aspects of compressing HOA coefficients is available in International Patent Application Publication No. WO 2014/194099, entitled "INTERPOLATION FOR DECOMPOSED REPRESENTATIONS OF A SOUND FIELD," filed 29 May 2014. In addition, more details of various aspects of the compression of the HOA coefficients in accordance with the MPEG-H 3D audio standard, including a discussion of the vector-based decomposition summarized below, can be found in a paper by Jurgen Herre, et al., entitled "MPEG-H 3D Audio—The New Standard for Coding of Immersive Spatial Audio," dated August 2015 and published in Vol. 9, No. 5 of the IEEE Journal of Selected Topics in Signal Processing.

As shown in the example of FIG. 5, the vector-based decomposition unit 27 may include a linear invertible transform (LIT) unit 30, a parameter calculation unit 32, a reorder unit 34, a foreground selection unit 36, an energy compensation unit 38, a mezzanine format unit 40, a soundfield analysis unit 44, a coefficient reduction unit 46, a background (BG) selection unit 48, a spatio-temporal interpolation unit 50, and a quantization unit 52.

The linear invertible transform (LIT) unit 30 receives the HOA coefficients 11 in the form of HOA channels, each channel representative of a block or frame of a coefficient associated with a given order, sub-order of the spherical basis functions (which may be denoted as HOA[k], where k may denote the current frame or block of samples). The matrix of HOA coefficients 11 may have dimensions D: $M\times(N+1)^2$.

That is, the LIT unit 30 may represent a unit configured to perform a form of analysis referred to as singular value decomposition. While described with respect to SVD, the techniques described in this disclosure may be performed with respect to any similar transformation or decomposition that provides for sets of linearly uncorrelated, energy compacted output. Also, reference to "sets" in this disclosure is generally intended to refer to non-zero sets unless specifically stated to the contrary and is not intended to refer to the classical mathematical definition of sets that includes the so-called "empty set."

An alternative transformation may comprise a principal component analysis, which is often referred to as "PCA." PCA refers to a mathematical procedure that employs an orthogonal transformation to convert a set of observations of possibly correlated variables into a set of linearly uncorrelated variables referred to as principal components. Linearly uncorrelated variables represent variables that do not have a linear statistical relationship (or dependence) to one another. These principal components may be described as having a small degree of statistical correlation to one another.

The number of so-called principal components is less than or equal to the number of original variables. In some examples, the transformation is defined in such a way that the first principal component has the largest possible variance (or, in other words, accounts for as much of the variability in the data as possible), and each succeeding component in turn has the highest variance possible under the constraint that this successive component be orthogonal to (which may be restated as uncorrelated with) the preceding components. PCA may perform a form of order-reduction, which in terms of the HOA coefficients 11 may result in the compression of the HOA coefficients 11. Depending on the context, PCA may be referred to by a number of different names, such as discrete Karhunen-Loeve transform, the Hotelling transform, proper orthogonal decomposition (POD), and eigenvalue decomposition (EVD) to name a few examples.

Assuming the LIT unit 30 performs a singular value decomposition (which, again, may be referred to as "SVD") for purposes of example, the LIT unit 30 may transform the HOA coefficients 11 into two or more sets of transformed HOA coefficients. The "sets" of transformed HOA coefficients may include vectors of transformed HOA coefficients. In the example of FIG. 5, the LIT unit 30 may perform the SVD with respect to the HOA coefficients 11 to generate a so-called V matrix, an S matrix, and a U matrix. SVD, in linear algebra, may represent a factorization of a y-by-z real or complex matrix X (where X may represent multi-channel audio data, such as the HOA coefficients 11) in the following form:

$$X=USV^*$$

U may represent a y-by-y real or complex unitary matrix, where the y columns of U are known as the left-singular vectors of the multi-channel audio data. S may represent a y-by-z rectangular diagonal matrix with non-negative real numbers on the diagonal, where the diagonal values of S are known as the singular values of the multi-channel audio data. V* (which may denote a conjugate transpose of V) may represent a z-by-z real or complex unitary matrix, where the z columns of V* are known as the right-singular vectors of the multi-channel audio data.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix. Below it is assumed, for ease of illustration purposes, that the HOA coefficients 11 comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to HOA coefficients 11 having complex coefficients, where the output of the SVD is the V* matrix. Accordingly, the techniques should not be limited in this respect to only provide for application of SVD to generate a V matrix, but may include application of SVD to HOA coefficients 11 having complex components to generate a V* matrix.

In this way, the LIT unit 30 may perform SVD with respect to the HOA coefficients 11 to output US[k] vectors 33 (which may represent a combined version of the S vectors and the U vectors) having dimensions D: $M\times(N+1)^2$, and V[k] vectors 35 having dimensions D: $(N+1)^2\times(N+1)^2$. Individual vector elements in the US[k] matrix may also be termed $X_{PS}(k)$ while individual vectors of the V[k] matrix may also be termed v(k).

An analysis of the U, S and V matrices may reveal that the matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) may instead be represented by individual $i^{th}$ vectors, $v^{(i)}(k)$, in the V matrix (each of length $(N+1)^2$).

The individual elements of each of $v^{(i)}(k)$ vectors may represent an HOA coefficient describing the shape (including width) and position of the soundfield for an associated audio object. Both the vectors in the U matrix and the V matrix are normalized such that their root-mean-square energies are equal to unity. The energy of the audio signals in U are thus represented by the diagonal elements in S. Multiplying U and S to form US[k] (with individual vector elements $X_{PS}(k)$), thus represent the audio signal with energies. The ability of the SVD decomposition to decouple the audio time-signals (in U), their energies (in S) and their spatial characteristics (in V) may support various aspects of the techniques described in this disclosure. Further, the model of synthesizing the underlying HOA[k] coefficients, X, by a vector multiplication of US[k] and V[k] gives rise the term "vector-based decomposition," which is used throughout this document.

Although described as being performed directly with respect to the HOA coefficients 11, the LIT unit 30 may apply the linear invertible transform to derivatives of the HOA coefficients 11. For example, the LIT unit 30 may apply SVD with respect to a power spectral density matrix derived from the HOA coefficients 11. By performing SVD with respect to the power spectral density (PSD) of the HOA coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the HOA coefficients.

The LIT unit 30 may, after applying the SVD (svd) to the PSD, obtain an $S[k]^2$ matrix (S_squared) and a V[k] matrix. The $S[k]^2$ matrix may denote a squared S[k] matrix, whereupon the LIT unit 30 may apply a square root operation to the $S[k]^2$ matrix to obtain the S[k] matrix. The LIT unit 30 may, in some instances, perform quantization with respect to the V[k] matrix to obtain a quantized V[k] matrix (which may be denoted as V[k]' matrix). The LIT unit 30 may obtain the U[k] matrix by first multiplying the S[k] matrix by the quantized V[k]' matrix to obtain an SV[k]' matrix. The LIT unit 30 may next obtain the pseudo-inverse (pinv) of the SV[k]' matrix and then multiply the HOA coefficients 11 by the pseudo-inverse of the SV[k]' matrix to obtain the U[k] matrix. The foregoing may be represented by the following pseud-code:

```
PSD=hoaFrame'*hoaFrame;
[V, S_squared]=svd(PSD,'econ');
S=sqrt(S_squared);
U=hoaFrame*pinv(S*V');
```

By performing SVD with respect to the power spectral density (PSD) of the HOA coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the HOA coefficients. That is, the above described PSD-type SVD may be potentially less computational demanding because the SVD is done on an F*F matrix (with F the number of HOA coefficients). Compared to a M*F matrix with M is the framelength, i.e., 1024 or more samples. The complexity of an SVD may now, through application to the PSD rather than the HOA coefficients 11, be around O(L^3) compared to O(M*L^2) when applied to the HOA coefficients 11 (where O(*) denotes the big-O notation of computation complexity common to the computer-science arts).

The parameter calculation unit 32 represents a unit configured to calculate various parameters, such as a correlation parameter (R), directional properties parameters (θ, ϕ, r), and an energy property (e). Each of the parameters for the current frame may be denoted as R[k], θ[k], ϕ[k], r[k] and e[k]. The parameter calculation unit 32 may perform an energy analysis and/or correlation (or so-called cross-correlation) with respect to the US[k] vectors 33 to identify the parameters. The parameter calculation unit 32 may also determine the parameters for the previous frame, where the previous frame parameters may be denoted R[k−1], θ[k−1], ϕ[k−1], r[k−1] and e[k−1], based on the previous frame of US[k−1] vector and V[k−1] vectors. The parameter calculation unit 32 may output the current parameters 37 and the previous parameters 39 to reorder unit 34.

The parameters calculated by the parameter calculation unit 32 may be used by the reorder unit 34 to re-order the audio objects to represent their natural evaluation or continuity over time. The reorder unit 34 may compare each of the parameters 37 from the first US[k] vectors 33 turn-wise against each of the parameters 39 for the second US[k−1] vectors 33. The reorder unit 34 may reorder (using, as one example, a Hungarian algorithm) the various vectors within the US[k] matrix 33 and the V[k] matrix 35 based on the current parameters 37 and the previous parameters 39 to output a reordered US[k] matrix 33' (which may be denoted mathematically as $\overline{US}[k]$) and a reordered V[k] matrix 35' (which may be denoted mathematically as $\overline{V}[k]$) to a foreground sound (or predominant sound—PS) selection unit 36 ("foreground selection unit 36") and an energy compensation unit 38.

The soundfield analysis unit 44 may represent a unit configured to perform a soundfield analysis with respect to the HOA coefficients 11 so as to potentially achieve a target bitrate 41. The soundfield analysis unit 44 may, based on the analysis and/or on a received target bitrate 41, determine the total number of psychoacoustic coder instantiations (which may be a function of the total number of ambient or background channels ($BG_{TOT}$) and the number of foreground channels or, in other words, predominant channels). The total number of psychoacoustic coder instantiations can be denoted as numHOATransportChannels.

The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHOAorder), the corresponding number of actual channels representative of the minimum order of background soundfield ($nBGa=(MinAmbHOAorder+1)^2$), and indices (i) of additional BG HOA channels to send (which may collectively be denoted as background channel information 43 in the example of FIG. 5). The background channel information 42 may also be referred to as ambient channel information 43. Each of the channels that remains from numHOATransportChannels—nBGa, may either be an "additional background/ambient channel", an "active vector-based predominant channel", an "active directional based predominant signal" or "completely inactive". In one aspect, the channel types may be indicated (as a "ChannelType") syntax element by two bits (e.g. 00: directional based signal; 01: vector-based predominant signal; 10: additional ambient signal; 11: inactive signal). The total number of background or ambient signals, nBGa, may be given by $(\text{MinAmbHOAorder}+1)^2$+the number of times the index 10 (in the above example) appears as a channel type in the bitstream for that frame.

The soundfield analysis unit 44 may select the number of background (or, in other words, ambient) channels and the number of foreground (or, in other words, predominant) channels based on the target bitrate 41, selecting more background and/or foreground channels when the target bitrate 41 is relatively higher (e.g., when the target bitrate 41 equals or is greater than 512 Kbps). In one aspect, the numHOATransportChannels may be set to 8 while the MinAmbHOAorder may be set to 1 in the header section of the bitstream. In this scenario, at every frame, four channels may be dedicated to represent the background or ambient portion of the soundfield while the other 4 channels can, on a frame-by-frame basis, vary on the type of channel—e.g., either used as an additional background/ambient channel or a foreground/predominant channel. The foreground/predominant signals can be one of either vector-based or directional based signals, as described above.

In some instances, the total number of vector-based predominant signals for a frame, may be given by the number of times the ChannelType index is 01 in the bitstream of that frame. In the above aspect, for every additional background/ambient channel (e.g., corresponding to a ChannelType of 10), corresponding information of each of the possible HOA coefficients (beyond the first four) may be represented in that channel. The information, for fourth order HOA content, may be an index to indicate the HOA coefficients 5-25. The first four ambient HOA coefficients 1-4 may be sent all the time when minAmbHOAorder is set to 1; hence the audio encoding device may only need to indicate one of the additional ambient HOA coefficient having an index of 5-25. The information could thus be sent using a 5 bits syntax element (for $4^{th}$ order content), which may be denoted as "CodedAmbCoeffIdx." In any event, the soundfield analysis unit 44 outputs the background channel information 43 and the HOA coefficients 11 to the background (BG) selection unit 36, the background channel information 43 to coefficient reduction unit 46 and the mezzanine format unit 40, and the nFG 45 to a foreground selection unit 36.

The background selection unit 48 may represent a unit configured to determine background or ambient HOA coefficients 47 based on the background channel information (e.g., the background soundfield ($N_{BG}$) and the number (nBGa) and the indices (i) of additional BG HOA channels to send). For example, when $N_{BG}$ equals one, the background selection unit 48 may select the HOA coefficients 11 for each sample of the audio frame having an order equal to or less than one. The background selection unit 48 may, in this example, then select the HOA coefficients 11 having an index identified by one of the indices (i) as additional BG HOA coefficients, where the nBGa is provided to the mezzanine format unit 40 to be specified in the bitstream 21 so as to enable the audio decoding device, such as the audio decoding device 24 shown in the example of FIGS. 6 and 7, to parse the background HOA coefficients 47 from the bitstream 21. The background selection unit 48 may then output the ambient HOA coefficients 47 to the energy compensation unit 38. The ambient HOA coefficients 47 may have dimensions D: $M\times[(N_{BG}+1)^2+\text{nBGa}]$. The ambient HOA coefficients 47 may also be referred to as "ambient HOA coefficients 47," where each of the ambient HOA coefficients 47 corresponds to a separate ambient HOA channel 47 to be encoded by the psychoacoustic audio coder unit 40.

The foreground selection unit 36 may represent a unit configured to select the reordered US[k] matrix 33' and the reordered V[k] matrix 35' that represent foreground or distinct components of the soundfield based on nFG 45 (which may represent a one or more indices identifying the foreground vectors). The foreground selection unit 36 may output nFG signals 49 (which may be denoted as a reordered $US[k]_{1,\ldots,nFG}$ 49, $FG_{1,\ldots,nfG}[k]$ 49, or $X_{PS}^{(1\ldots nFG)}(k)$ 49) to the psychoacoustic audio coder unit 40, where the nFG signals 49 may have dimensions D: M×nFG and each represent mono-audio objects. The foreground selection unit 36 may also output the reordered V[k] matrix 35' (or $v^{(1\ldots nFG)}(k)$ 35') corresponding to foreground components of the soundfield to the spatio-temporal interpolation unit 50, where a subset of the reordered V[k] matrix 35' corresponding to the foreground components may be denoted as foreground V[k] matrix $\mathbf{51}_k$ (which may be mathematically denoted as $\overline{V}_{1,\ldots,nFG}[k]$) having dimensions D: $(N+1)^2\times$nFG.

The energy compensation unit 38 may represent a unit configured to perform energy compensation with respect to the ambient HOA coefficients 47 to compensate for energy loss due to removal of various ones of the HOA channels by the background selection unit 48. The energy compensation unit 38 may perform an energy analysis with respect to one or more of the reordered US[k] matrix 33', the reordered V[k] matrix 35', the nFG signals 49, the foreground V[k] vectors $\mathbf{51}_k$ and the ambient HOA coefficients 47 and then perform energy compensation based on the energy analysis to generate energy compensated ambient HOA coefficients 47'. The energy compensation unit 38 may output the energy compensated ambient HOA coefficients 47' to the mezzanine format unit 40.

The spatio-temporal interpolation unit 50 may represent a unit configured to receive the foreground V[k] vectors $\mathbf{51}_k$ for the $k^{th}$ frame and the foreground V[k−1] vectors $\mathbf{51}_{k-1}$ for the previous frame (hence the k−1 notation) and perform spatio-temporal interpolation to generate interpolated foreground V[k] vectors. The spatio-temporal interpolation unit 50 may recombine the nFG signals 49 with the foreground V[k] vectors $\mathbf{51}_k$ to recover reordered foreground HOA coefficients. The spatio-temporal interpolation unit 50 may then divide the reordered foreground HOA coefficients by the interpolated V[k] vectors to generate interpolated nFG signals 49'.

The spatio-temporal interpolation unit 50 may also output the foreground V[k] vectors $\mathbf{51}_k$ that were used to generate the interpolated foreground V[k] vectors. An audio decoding device, such as the audio decoding device 24, may generate the interpolated foreground V[k] vectors based on the output foreground V[k] vectors $\mathbf{51}_k$ and thereby recover the foreground V[k] vectors $\mathbf{51}_k$. The foreground V[k] vectors $\mathbf{51}_k$ used to generate the interpolated foreground V[k] vectors are denoted as the remaining foreground V[k] vectors 53. In order to ensure that the same V[k] and V[k−1] are used at the encoder and decoder (to create the interpolated vectors V[k]) quantized/dequantized versions of the vectors may be used at the encoder and decoder. The spatio-temporal interpolation unit 50 may output the interpolated nFG signals 49' to the mezzanine format unit 40 and the interpolated foreground V[k] vectors $\mathbf{51}_k$ to the coefficient reduction unit 46.

The coefficient reduction unit 46 may represent a unit configured to perform coefficient reduction with respect to the remaining foreground V[k] vectors 53 based on the background channel information 43 to output reduced foreground V[k] vectors 55 to the quantization unit 52. The reduced foreground V[k] vectors 55 may have dimensions D: $[(N+1)^2-(N_{BG}+1)^2-BG_{TOT}]\times nFG$. The coefficient reduction unit 46 may, in this respect, represent a unit configured to reduce the number of coefficients in the remaining foreground V[k] vectors 53. In other words, coefficient reduction unit 46 may represent a unit configured to eliminate the coefficients in the foreground V[k] vectors (that form the remaining foreground V[k] vectors 53) having little to no directional information. In some examples, the coefficients of the distinct or, in other words, foreground V[k] vectors corresponding to a first and zero order basis functions (which may be denoted as $N_{BG}$) provide little directional information and therefore can be removed from the foreground V-vectors (through a process that may be referred to as "coefficient reduction"). In this example, greater flexibility may be provided to not only identify the coefficients that correspond $N_{BG}$ but to identify additional HOA channels (which may be denoted by the variable TotalOfAddAmbHOAChan) from the set of $[(N_{BG}+1)^2+1, (N+1)^2]$.

The quantization unit 52 may represent a unit configured to perform any form of quantization to compress the reduced foreground V[k] vectors 55 to generate coded foreground V[k] vectors 57, outputting the coded foreground V[k] vectors 57 to the mezzanine format unit 40. In operation, the quantization unit 52 may represent a unit configured to compress a spatial component of the soundfield, i.e., one or more of the reduced foreground V[k] vectors 55 in this example. The quantization unit 52 may perform any one of the following 12 quantization modes, as indicated by a quantization mode syntax element denoted "NbitsQ":

| NbitsQ value | Type of Quantization Mode |
|---|---|
| 0-3: | Reserved |
| 4: | Vector Quantization |
| 5: | Scalar Quantization without Huffman Coding |
| 6: | 6-bit Scalar Quantization with Huffman Coding |
| 7: | 7-bit Scalar Quantization with Huffman Coding |
| 8: | 8-bit Scalar Quantization with Huffman Coding |
| . . . | . . . |
| 16: | 16-bit Scalar Quantization with Huffman Coding |

The quantization unit 52 may also perform predicted versions of any of the foregoing types of quantization modes, where a difference is determined between an element of (or a weight when vector quantization is performed) of the V-vector of a previous frame and the element (or weight when vector quantization is performed) of the V-vector of a current frame is determined. The quantization unit 52 may then quantize the difference between the elements or weights of the current frame and previous frame rather than the value of the element of the V-vector of the current frame itself.

The quantization unit 52 may perform multiple forms of quantization with respect to each of the reduced foreground V[k] vectors 55 to obtain multiple coded versions of the reduced foreground V[k] vectors 55. The quantization unit 52 may select the one of the coded versions of the reduced foreground V[k] vectors 55 as the coded foreground V[k] vector 57. The quantization unit 52 may, in other words, select one of the non-predicted vector-quantized V-vector, predicted vector-quantized V-vector, the non-Huffman-coded scalar-quantized V-vector, and the Huffman-coded scalar-quantized V-vector to use as the output switched-quantized V-vector based on any combination of the criteria discussed in this disclosure.

In some examples, the quantization unit 52 may select a quantization mode from a set of quantization modes that includes a vector quantization mode and one or more scalar quantization modes, and quantize an input V-vector based on (or according to) the selected mode. The quantization unit 52 may then provide the selected one of the non-predicted vector-quantized V-vector (e.g., in terms of weight values or bits indicative thereof), predicted vector-quantized V-vector (e.g., in terms of error values or bits indicative thereof), the non-Huffman-coded scalar-quantized V-vector and the Huffman-coded scalar-quantized V-vector to the mezzanine format unit 40 as the coded foreground V[k] vectors 57. The quantization unit 52 may also provide the syntax elements indicative of the quantization mode (e.g., the NbitsQ syntax element) and any other syntax elements used to dequantize or otherwise reconstruct the V-vector.

The mezzanine format unit 40 included within the spatial audio encoding device 20 may represent a unit that formats data to conform to a known format (which may refer to a format known by a decoding device), thereby generating the mezzanine formatted audio data 15. The mezzanine format unit 40 may represent a multiplexer in some examples, which may receive the coded foreground V[k] vectors 57 energy compensated ambient HOA coefficients 47', the interpolated nFG signals 49' and the background channel information 43. The mezzanine format unit 40 may then generate the mezzanine formatted audio data 15 based on the coded foreground V[k] vectors 57, the energy compensated ambient HOA coefficients 47', the interpolated nFG signals 49' and the background channel information 43.

As noted above, the mezzanine formatted audio data 15 may include PCM transport channels and sideband (or, in other words, sidechannel) information. The sideband information may include the V[k] vectors 47 and other syntax elements described in more detail in the above referenced International Patent Application Publication No. WO 2014/194099, entitled "INTERPOLATION FOR DECOMPOSED REPRESENTATIONS OF A SOUND FIELD," filed 29 May 2014.

Although not shown in the example of FIG. 5, the spatial audio encoding device 20 may also include a bitstream output unit that switches the bitstream output from the audio encoding device 20 (e.g., between the directional-based bitstream 21 and the vector-based bitstream 21) based on whether a current frame is to be encoded using the directional-based synthesis or the vector-based synthesis. The bitstream output unit may perform the switch based on the syntax element output by the content analysis unit 26 indicating whether a directional-based synthesis was performed (as a result of detecting that the HOA coefficients 11 were generated from a synthetic audio object) or a vector-based synthesis was performed (as a result of detecting that the HOA coefficients were recorded). The bitstream output unit may specify the correct header syntax to indicate the switch or current encoding used for the current frame along with the respective one of the bitstreams 21.

Moreover, as noted above, the soundfield analysis unit 44 may identify $BG_{TOT}$ ambient HOA coefficients 47, which may change on a frame-by-frame basis (although at times $BG_{TOT}$ may remain constant or the same across two or more adjacent (in time) frames). The change in $BG_{TOT}$ may result in changes to the coefficients expressed in the reduced foreground V[k] vectors 55. The change in $BG_{TOT}$ may result in background HOA coefficients (which may also be referred to as "ambient HOA coefficients") that change on a frame-by-frame basis (although, again, at times $BG_{TOT}$ may remain constant or the same across two or more adjacent (in time) frames). The changes often result in a change of energy for the aspects of the sound field represented by the addition or removal of the additional ambient HOA coefficients and the corresponding removal of coefficients from or addition of coefficients to the reduced foreground V[k] vectors 55.

As a result, the soundfield analysis unit 44 may further determine when the ambient HOA coefficients change from frame to frame and generate a flag or other syntax element indicative of the change to the ambient HOA coefficient in terms of being used to represent the ambient components of the sound field (where the change may also be referred to as a "transition" of the ambient HOA coefficient or as a "transition" of the ambient HOA coefficient). In particular, the coefficient reduction unit 46 may generate the flag (which may be denoted as an AmbCoeffTransition flag or an AmbCoeffIdxTransition flag), providing the flag to the mezzanine format unit 40 so that the flag may be included in the bitstream 21 (possibly as part of side channel information).

The coefficient reduction unit 46 may, in addition to specifying the ambient coefficient transition flag, also modify how the reduced foreground V[k] vectors 55 are generated. In one example, upon determining that one of the ambient HOA ambient coefficients is in transition during the current frame, the coefficient reduction unit 46 may specify, a vector coefficient (which may also be referred to as a "vector element" or "element") for each of the V-vectors of the reduced foreground V[k] vectors 55 that corresponds to the ambient HOA coefficient in transition. Again, the ambient HOA coefficient in transition may add or remove from the $BG_{TOT}$ total number of background coefficients. Therefore, the resulting change in the total number of background coefficients affects whether the ambient HOA coefficient is included or not included in the bitstream, and whether the corresponding element of the V-vectors are included for the V-vectors specified in the bitstream in the second and third configuration modes described above. More information regarding how the coefficient reduction unit 46 may specify the reduced foreground V[k] vectors 55 to overcome the changes in energy is provided in U.S. application Ser. No. 14/594,533, entitled "TRANSITIONING OF AMBIENT HIGHER_ORDER AMBISONIC COEFFICIENTS," filed Jan. 12, 2015.

FIG. 6 is a block diagram illustrating the audio decoding device 24 of FIG. 2 in more detail. As shown in the example of FIG. 6, the audio decoding device 24 may include an extraction unit 72 and a vector-based reconstruction unit 92. Although described below, more information regarding the audio decoding device 24 and the various aspects of decompressing or otherwise decoding HOA coefficients is available in International Patent Application Publication No. WO 2014/194099, entitled "INTERPOLATION FOR DECOMPOSED REPRESENTATIONS OF A SOUND FIELD," filed 29 May 2014. In addition, more details of various aspects of the decompression of the HOA coefficients in accordance with the MPEG-H 3D audio standard, including a discussion of the vector-based reconstruction summarized below, can be found in a paper by Jürgen Herre, et al., entitled "MPEG-H 3D Audio—The New Standard for Coding of Immersive Spatial Audio," dated August 2015 and published in Vol. 9, No. 5 of the IEEE Journal of Selected Topics in Signal Processing.

The extraction unit 72 may represent a unit configured to receive the bitstream 15 and extract a vector-based encoded version of the HOA coefficients 11. The extraction unit 72 may determine from the above noted syntax element information indicative of whether the HOA coefficients 11 were encoded via vector-based versions. The extraction unit 72 may extract the coded foreground V[k] vectors 57 (which may include coded weights 57 and/or indices 63 or scalar quantized V-vectors), the encoded ambient HOA coefficients 59 and the corresponding audio objects 61 (which may also be referred to as the encoded nFG signals 61). The audio objects 61 each correspond to one of the vectors 57. The extraction unit 72 may pass the coded foreground V[k] vectors 57 to the V-vector reconstruction unit 74 and the encoded ambient HOA coefficients 59 along with the encoded nFG signals 61 to the psychoacoustic decoding unit 80.

The V-vector reconstruction unit 74 may represent a unit configured to reconstruct the V-vectors from the encoded foreground V[k] vectors 57. The V-vector reconstruction unit 74 may operate in a manner reciprocal to that of the quantization unit 52.

The psychoacoustic decoding unit 80 may operate in a manner reciprocal to the psychoacoustic audio coder unit 40 shown in the example of FIG. 2 so as to decode the encoded ambient HOA coefficients 59 and the encoded nFG signals 61 and thereby generate energy compensated ambient HOA coefficients 47' and the interpolated nFG signals 49' (which may also be referred to as interpolated nFG audio objects 49'). The psychoacoustic decoding unit 80 may pass the energy compensated ambient HOA coefficients 47' to the fade unit 770 and the nFG signals 49' to the foreground formulation unit 78.

The spatio-temporal interpolation unit 76 may operate in a manner similar to that described above with respect to the spatio-temporal interpolation unit 50. The spatio-temporal interpolation unit 76 may receive the reduced foreground V[k] vectors $\mathbf{55}_k$ and perform the spatio-temporal interpolation with respect to the foreground V[k] vectors $\mathbf{55}_k$ and the reduced foreground V[k−1] vectors $\mathbf{55}_{k-1}$ to generate interpolated foreground V[k] vectors $\mathbf{55}_k''$. The spatio-temporal interpolation unit 76 may forward the interpolated foreground V[k] vectors $\mathbf{55}_k''$ to the fade unit 770.

The extraction unit 72 may also output a signal 757 indicative of when one of the ambient HOA coefficients is in transition to fade unit 770, which may then determine which of the $SHC_{BG}$ 47 ' (where the $SHC_{BG}$ 47 ' may also be denoted as "ambient HOA channels 47'''" or "energy compensated ambient HOA coefficients 47'''") and the elements of the interpolated foreground V[k] vectors $\mathbf{55}_k''$ are to be either faded-in or faded-out. In some examples, the fade unit 770 may operate opposite with respect to each of the ambient HOA coefficients 47' and the elements of the interpolated foreground V[k] vectors $\mathbf{55}_k''$. That is, the fade unit 770 may perform a fade-in or fade-out, or both a fade-in and fade-out with respect to a corresponding one of the ambient HOA coefficients 47', while performing a fade-in or fade-out or both a fade-in and a fade-out, with respect to the corresponding one of the elements of the interpolated foreground V[k] vectors $\mathbf{55}_k''$. The fade unit 770 may output adjusted ambient HOA coefficients 47'' to the HOA coefficient formulation unit 82 and adjusted foreground V[k] vectors $\mathbf{55}_k'''$ to the foreground formulation unit 78. In this respect, the fade unit 770 represents a unit configured to perform a fade operation with respect to various aspects of the HOA coefficients or derivatives thereof, e.g., in the form of the ambient HOA coefficients 47' and the elements of the interpolated foreground V[k] vectors $\mathbf{55}_k''$.

The foreground formulation unit 78 may represent a unit configured to perform matrix multiplication with respect to the adjusted foreground V[k] vectors $\mathbf{55}_k'''$ and the interpolated nFG signals 49' to generate the foreground HOA coefficients 65. In this respect, the foreground formulation unit 78 may combine the audio objects 49' (which is another way by which to denote the interpolated nFG signals 49') with the vectors $\mathbf{55}_k'''$ to reconstruct the foreground or, in other words, predominant aspects of the HOA coefficients 11'. The foreground formulation unit 78 may perform a matrix multiplication of the interpolated nFG signals 49' by the adjusted foreground V[k] vectors $\mathbf{55}_k'''$.

The HOA coefficient formulation unit 82 may represent a unit configured to combine the foreground HOA coefficients 65 to the adjusted ambient HOA coefficients 47" so as to obtain the HOA coefficients 11'. The prime notation reflects that the HOA coefficients 11' may be similar to but not the same as the HOA coefficients 11. The differences between the HOA coefficients 11 and 11' may result from loss due to transmission over a lossy transmission medium, quantization or other lossy operations.

Figure 7:
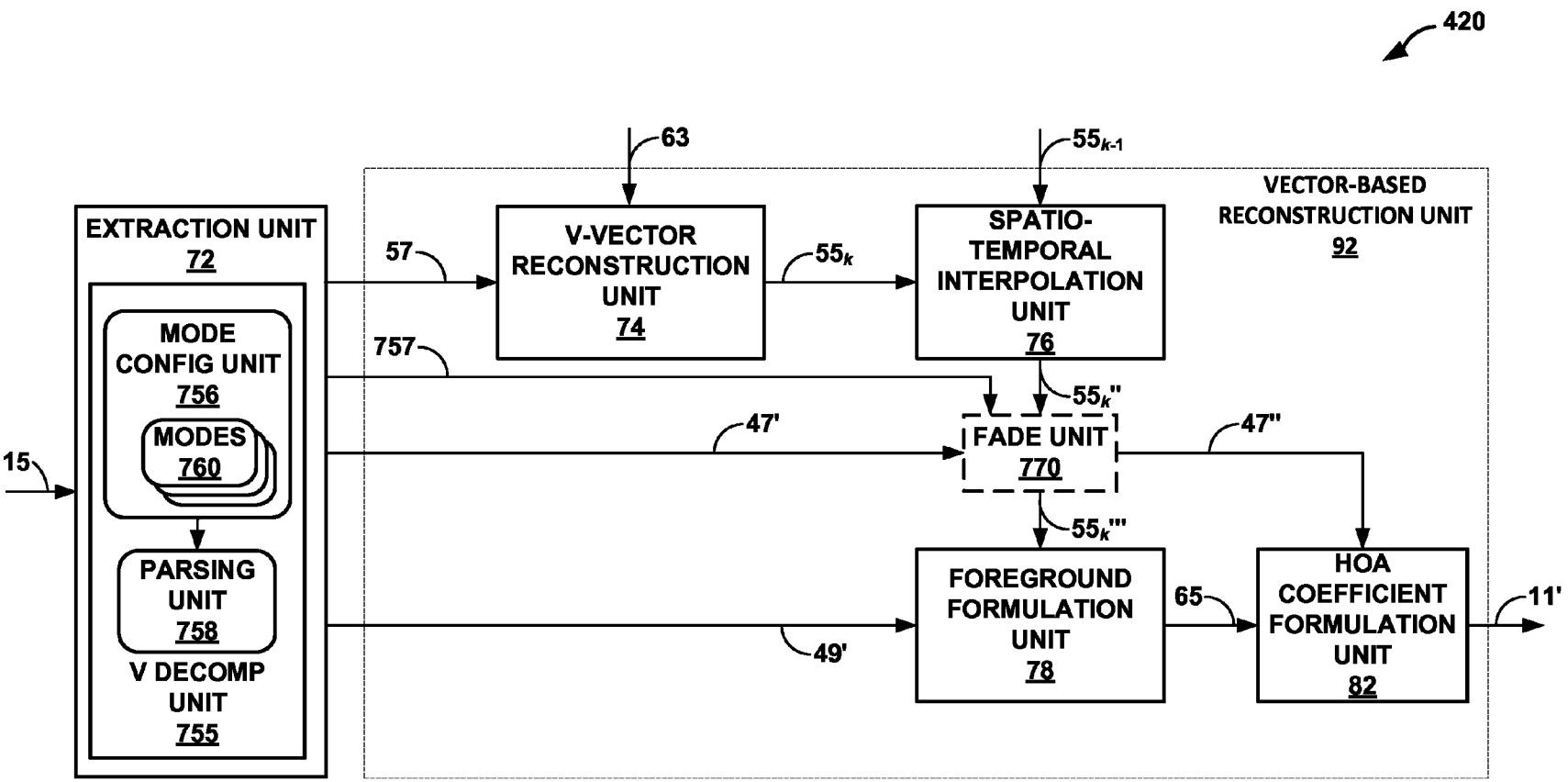
FIG. 7 is a block diagram illustrating the spatial audio decoding device of FIGS. 3A-3C in more detail.

FIG. 7 is a block diagram illustrating a spatial audio decoding device 420 of FIGS. 3A-3C in more detail. The spatial audio decoding device 420 may be similar to the audio decoding device 24 shown in the examples of FIGS. 2 and 6, except that the spatial audio decoding device 420 does not include a psychoacoustic decoding unit 80, as the mezzanine formatted audio data 15 has not been or otherwise undergone processing by a psychoacoustic audio encoder. As such, the extraction unit 72 outputs the energy compensated ambient HOA coefficients 47' directly to the fade unit 770 and the interpolated nFG signals 49' directly to foreground formulation unit 78 (meaning, without first performing psychoacoustic audio decoding with respect to these coefficients 47' and signals 49').

Figure 8A:
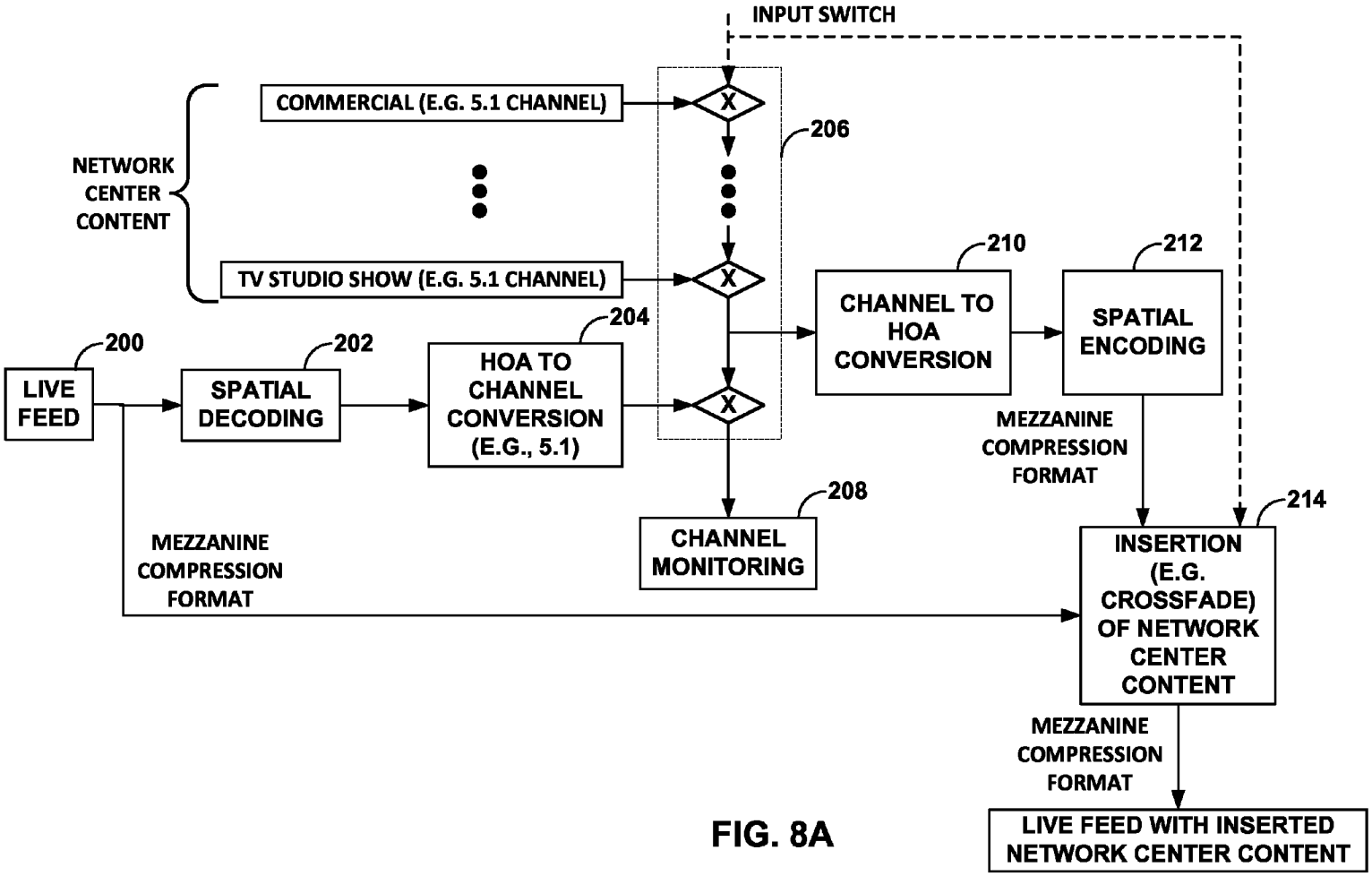
FIG. 8A-8C are flowcharts illustrating exemplary operation of the broadcast network centers of FIGS. 3A-3C in performing various aspects of the techniques described in this disclosure.
Figure 8B:
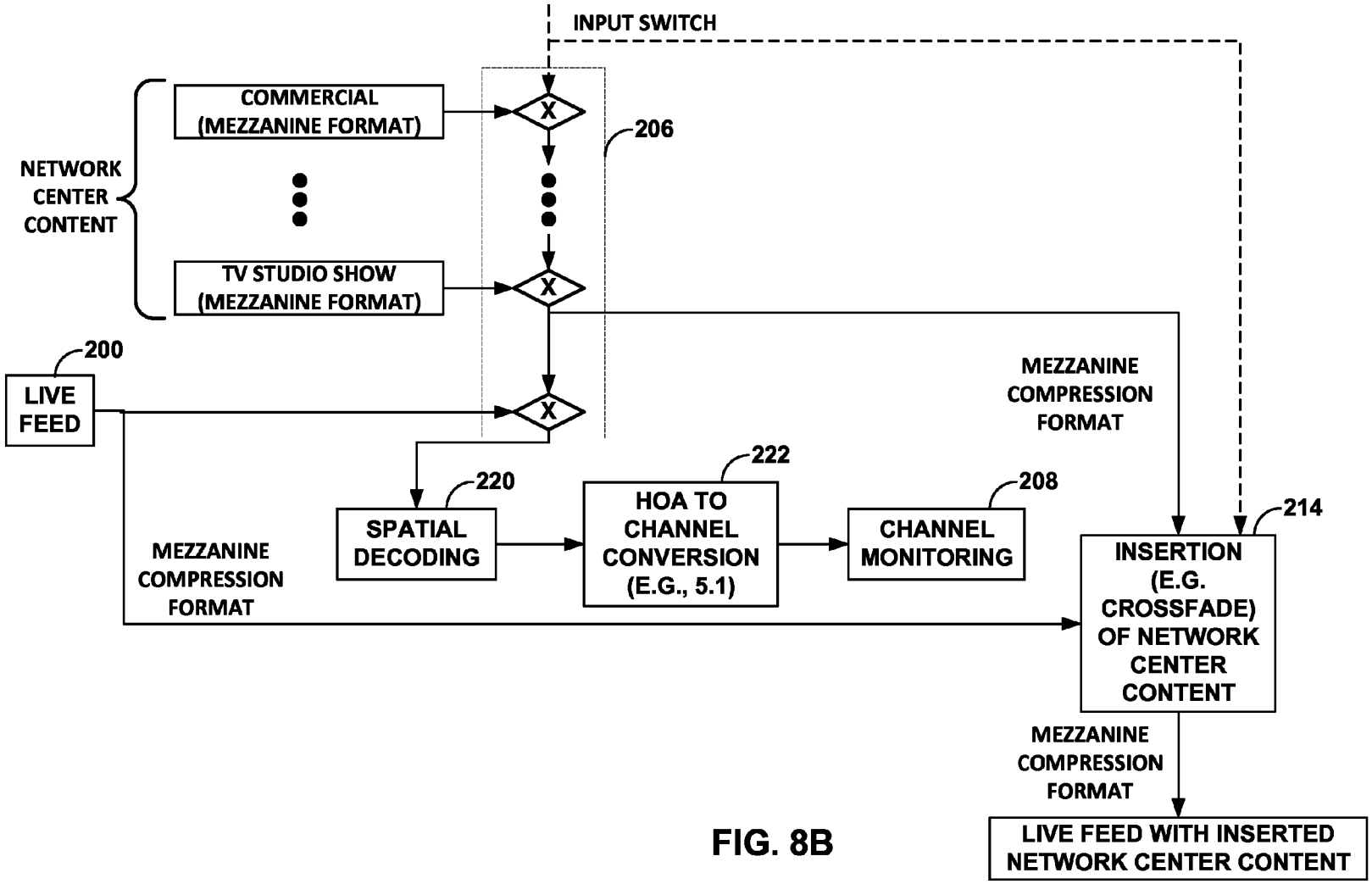
Figure 8C:
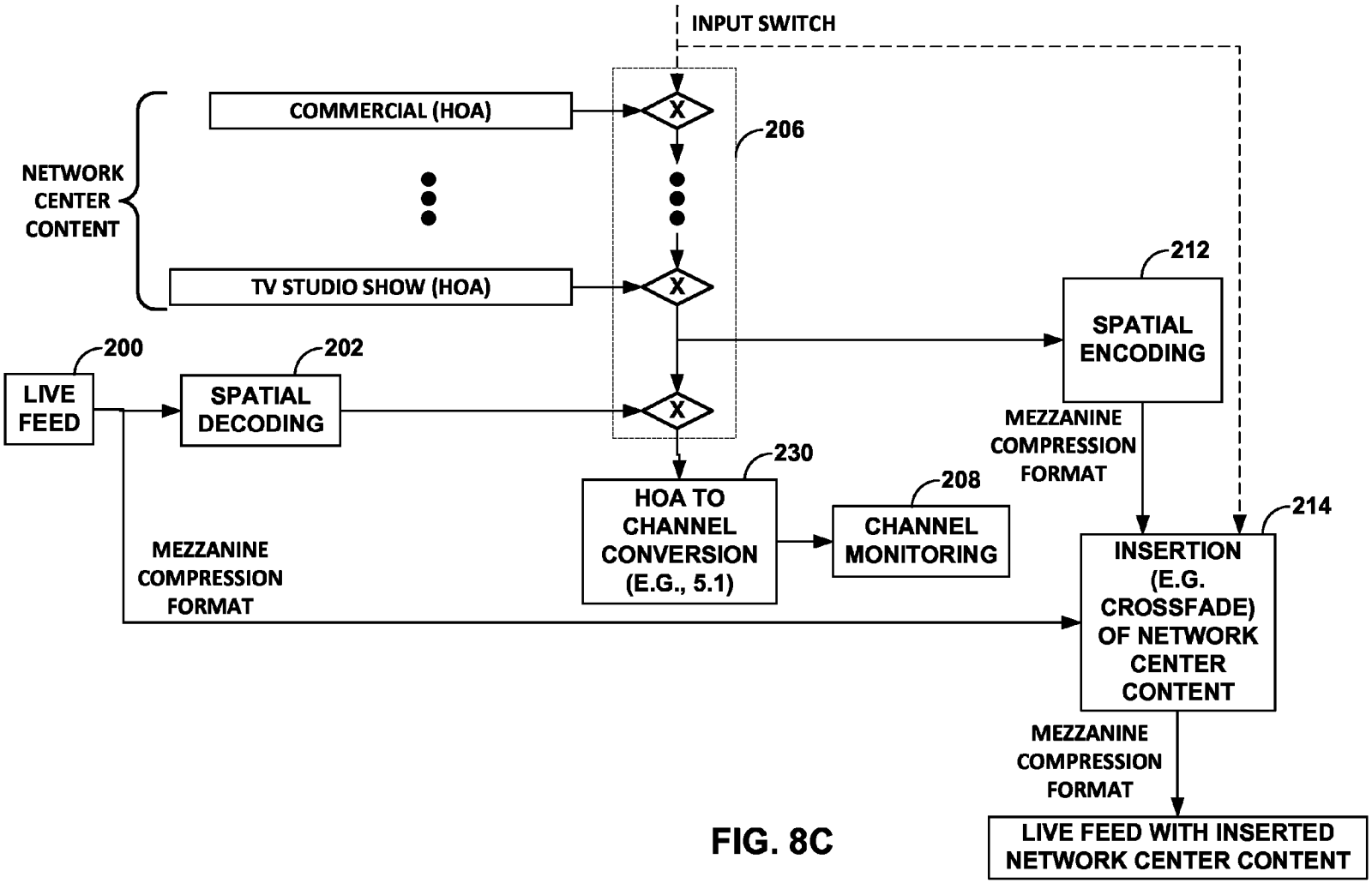

FIGS. 8A-8C are block diagrams each illustrating various operations that the broadcast network centers shown in FIG. 3A-3C are configured to perform. In the example of FIG. 8A, the broadcasting network center 402A may receive a live feed conforming to the mezzanine compression format (200). The spatial audio decoding device 410 of the broadcasting network center 402A may perform spatial decoding of the mezzanine formatted audio data (202), where the mezzanine formatted audio data may represent one example of intermediately compressed audio data having been compressed to a format prior to application of potentially additional compression to the intermediately compressed audio data. The result of performing the spatial decoding may comprise HOA coefficients 11.

The HOA conversion device 412 of the broadcasting network center 402A may perform an HOA-to-channel conversion (204) to convert the HOA coefficients 11 to a channel-based representation 413 (which may refer to a spatial domain representation in contrast to the HOA-domain representation of the HOA coefficients 11). Responsive to an input switch 417, the switching device 414 of the broadcasting network center 402A may select between the network center content 415 (e.g., in a 5.1 channel-based format) and the channel-based representation 413 (e.g., in a 5.1 channel-based format) (206). The monitoring device 416 may perform channel monitoring of the network center content 415 and the channel-based representation 413 (208).

Responsive to an additional input switch 417, the switching device 414 may output the network center content 415 to the inverse HOA conversion device 418. The inverse HOA conversion device 418 may perform a channel-to-HOA conversion (210) with respect to the output one of the network center content 415 to generate converted additional audio data 419 (210). The spatial audio encoding device 420 may output mezzanine formatted additional audio data 421 to the insertion device 422.

The insertion device 422 may represent a device or unit configured to insert the mezzanine formatted additional audio data 421 into the mezzanine formatted audio data 15. In some examples, the insertion device 422 inserts mezzanine formatted additional audio data 421 into the original mezzanine formatted audio data 15, where the original mezzanine formatted audio data 15 has not undergone spatial audio decoding (or, in other words, mezzanine decompression), HOA conversion, spatial audio re-encoding and inverse HOA conversion, so as to avoid potential injection of audio artifacts into the updated mezzanine formatted audio data 17 (212). The insertion device 422 may insert the mezzanine formatted audio data 421 into the mezzanine formatted audio data 15 by, at least in part, fading (including, in some examples, crossfading) the mezzanine formatted audio data 421 into the mezzanine formatted audio data 15 (214).

In the example of FIG. 8B, the operations performed by the broadcasting network center 402B of FIG. 3B may, as noted above, be substantially similar to the operations performed by the broadcasting network center 402A as described above with respect to FIG. 8A, except that the additional audio data 421A-421N shown in the example of FIG. 8B is already specified in the mezzanine format (MF). The MF audio data 421 may each be substantially similar to the mezzanine formatted additional audio data 421 described above with respect to the example of FIG. 8A.

Given that the MF audio data 425 (shown in FIG. 3B) is specified in accordance with the mezzanine format, the broadcasting network center 402B may not include the inverse HOA conversion device 418 and the spatial audio encoding device 420 described above with respect to the broadcasting network center 402A or perform the corresponding operations denoted as spatial decoding (202) and HOA-to-channel conversion (204). Because all of the audio data 421 and 15 input into the switching device 414 is specified in the same format (e.g., mezzanine format), no spatial audio decoding and conversion may be required prior to processing by switching device 417.

To monitor the MF additional audio data 421 and the MF audio data 15, the broadcasting network center 402B may include the spatial audio decoding device 410 and the HOA conversion device 412 to perform spatial audio decoding (220) and HOA-to-channel conversion (222) with respect to the outputs of the switching device 414. The spatial audio decoding and HOA conversion may result in audio data specified in the spatial domain (e.g., 5.1 audio data) that is then input to the monitoring device 416 to allow an operator, editor or other broadcasting personnel to monitor the selected one (as specified by input data 417) of the inputs to the switching device 414. The spatial domain may also be referred to as a "channel domain."

In the example of FIG. 8C, the operations performed by the broadcasting network center 402C of FIG. 3C may, as noted above, be substantially similar to the operations performed by the broadcasting network center 402A as described above with respect to FIG. 8A, except that the additional audio data 425A-425N shown in the example of FIG. 3C is specified in the HOA format (or, in other words, in the spherical harmonic domain).

Given that the HOA audio data 425 is specified in accordance with the HOA format, the broadcasting network center 402C may not include the inverse HOA conversion device 418. However, the broadcasting network center 402C may include the spatial audio encoding device 420 described above with respect to the broadcasting network center 402A so as to perform mezzanine compression with respect to the HOA audio data 425 to obtain MF additional audio data 421 (212). Because the audio data 425 is specified in the HOA domain (or, in other words, the spherical harmonic domain), the spatial audio decoding device 410 performs spatial audio decoding with respect to the mezzanine formatted audio data 15 to obtain the HOA coefficients 11, thereby potentially harmonizing the input format into switching device 414.

To monitor the HOA audio data 421 and 11, the broadcasting network center 402C may include the HOA conversion device 412 to perform HOA-to-channel conversion with respect to the outputs of the switching device 414 (230). The HOA conversion may result in audio data specified in the spatial domain (e.g., 5.1 audio data) that is then input to the monitoring device 416 to allow an operator, editor or other broadcasting personnel to monitor the selected one (as specified by input data 417) of the inputs to the switching device 414.

Figure 9:
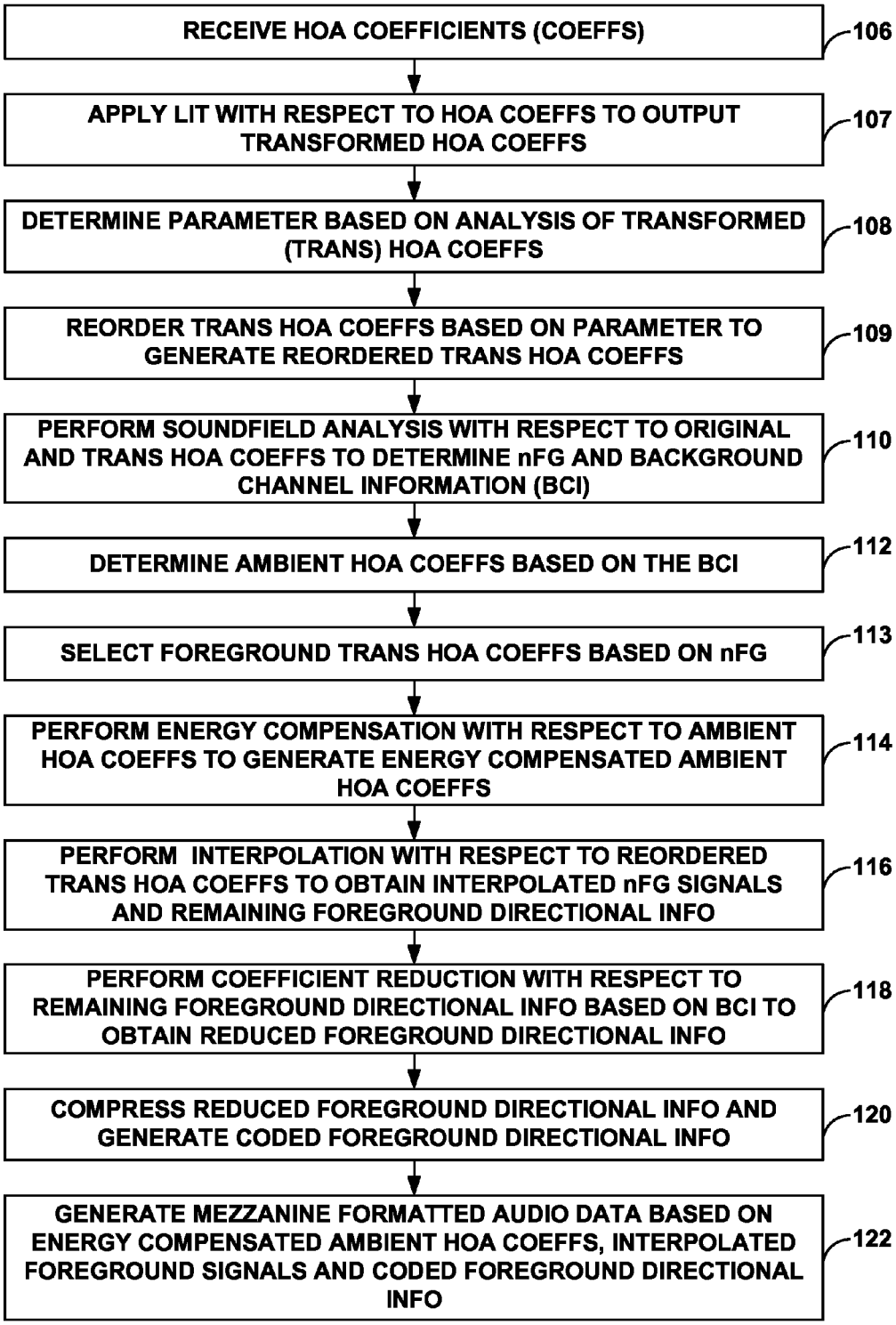
FIG. 9 is a flowchart illustrating exemplary operation of a spatial audio encoding device in performing various aspects of the vector-based synthesis techniques described in this disclosure.

FIG. 9 is a flowchart illustrating exemplary operation of an audio encoding device, such as the spatial audio encoding device 20 shown in the example of FIG. 4, in performing various aspects of the vector-based synthesis techniques described in this disclosure. Initially, the spatial audio encoding device 20 receives the HOA coefficients 11 (106). The spatial audio encoding device 20 may invoke the LIT unit 30, which may apply a LIT with respect to the HOA coefficients to output transformed HOA coefficients (e.g., in the case of SVD, the transformed HOA coefficients may comprise the US[k] vectors 33 and the V[k] vectors 35) (107).

The spatial audio encoding device 20 may next invoke the parameter calculation unit 32 to perform the above described analysis with respect to any combination of the US[k] vectors 33, US[k−1] vectors 33, the V[k] and/or V[k−1] vectors 35 to identify various parameters in the manner described above. That is, the parameter calculation unit 32 may determine at least one parameter based on an analysis of the transformed HOA coefficients 33/35 (108).

The spatial audio encoding device 20 may then invoke the reorder unit 34, which may reorder the transformed HOA coefficients (which, again in the context of SVD, may refer to the US[k] vectors 33 and the V[k] vectors 35) based on the parameter to generate reordered transformed HOA coefficients 33'/35' (or, in other words, the US[k] vectors 33' and the V[k] vectors 35'), as described above (109). The spatial audio encoding device 20 may, during any of the foregoing operations or subsequent operations, also invoke the soundfield analysis unit 44. The soundfield analysis unit 44 may, as described above, perform a soundfield analysis with respect to the HOA coefficients 11 and/or the transformed HOA coefficients 33/35 to determine the total number of foreground channels (nFG) 45, the order of the background soundfield ($N_{BG}$) and the number (nBGa) and indices (i) of additional BG HOA channels to send (which may collectively be denoted as background channel information 43 in the example of FIG. 5) (110).

The spatial audio encoding device 20 may also invoke the background selection unit 48. The background selection unit 48 may determine background or ambient HOA coefficients 47 based on the background channel information (BCI) 43 (112). The spatial audio encoding device 20 may further invoke the foreground selection unit 36, which may select those of the reordered US[k] vectors 33' and the reordered V[k] vectors 35' that represent foreground or distinct components of the soundfield based on nFG 45 (which may represent a one or more indices identifying these foreground vectors) (113).

The spatial audio encoding device 20 may invoke the energy compensation unit 38. The energy compensation unit 38 may perform energy compensation with respect to the ambient HOA coefficients 47 to compensate for energy loss due to removal of various ones of the HOA channels by the background selection unit 48 (114) and thereby generate energy compensated ambient HOA coefficients 47'.

The spatial audio encoding device 20 also then invoke the spatio-temporal interpolation unit 50. The spatio-temporal interpolation unit 50 may perform spatio-temporal interpolation with respect to the reordered transformed HOA coefficients 33'/35' to obtain the interpolated foreground signals 49' (which may also be referred to as the "interpolated nFG signals 49'") and the remaining foreground directional information 53 (which may also be referred to as the "V[k] vectors 53") (116). The spatial audio encoding device 20 may then invoke the coefficient reduction unit 46. The coefficient reduction unit 46 may perform coefficient reduction with respect to the remaining foreground V[k] vectors 53 based on the background channel information 43 to obtain reduced foreground directional information 55 (which may also be referred to as the reduced foreground V[k] vectors 55) (118).

The spatial audio encoding device 20 may then invoke the quantization unit 52 to compress, in the manner described above, the reduced foreground V[k] vectors 55 and generate coded foreground V[k] vectors 57 (120).

The spatial audio encoding device 20 may then invoke the mezzanine format unit 40. The mezzanine format unit 40 may generate the mezzanine formatted audio data 15 based on the coded foreground V[k] vectors 57 energy compensated ambient HOA coefficients 47', the interpolated nFG signals 49' and the background channel information 43 (122).

Figure 10:
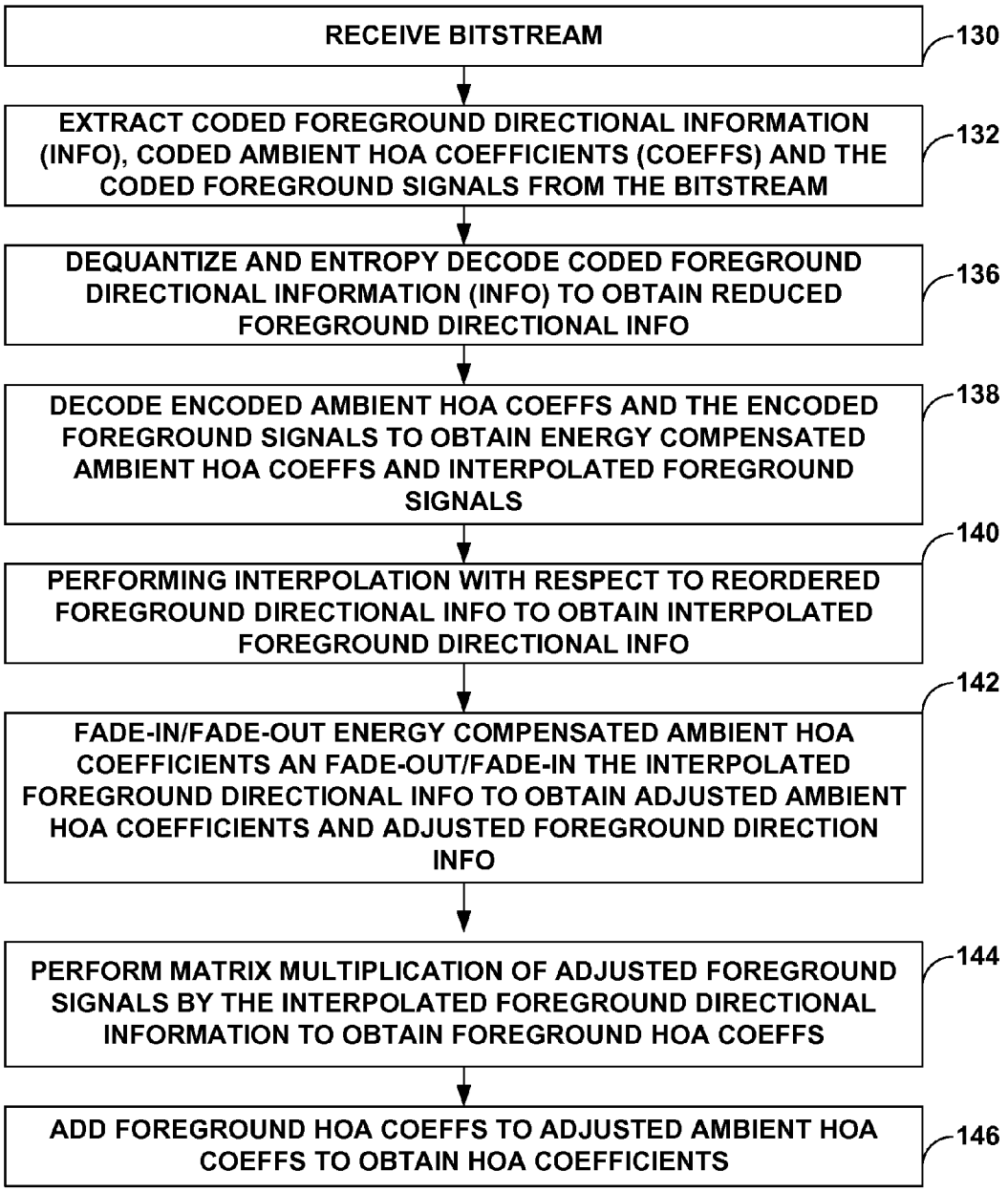
FIG. 10 is a flow chart illustrating exemplary operation of an audio decoding device in performing various aspects of the techniques described in this disclosure.

FIG. 10 is a flow chart illustrating exemplary operation of an audio decoding device, such as the audio decoding device 24 shown in FIG. 6, in performing various aspects of the techniques described in this disclosure. Initially, the audio decoding device 24 may receive the bitstream 21 (130). Upon receiving the bitstream, the audio decoding device 24 may invoke the extraction unit 72. Assuming for purposes of discussion that the bitstream 21 indicates that vector-based reconstruction is to be performed, the extraction device 72 may parse this bitstream to retrieve the above noted information, passing this information to the vector-based reconstruction unit 92.

In other words, the extraction unit 72 may extract the coded foreground directional information 57 (which, again, may also be referred to as the coded foreground V[k] vectors 57), the coded ambient HOA coefficients 59 and the coded foreground signals (which may also be referred to as the coded foreground nFG signals 59 or the coded foreground audio objects 59) from the bitstream 21 in the manner described above (132).

The audio decoding device 24 may further invoke the quantization unit 74. The quantization unit 74 may entropy decode and dequantize the coded foreground directional information 57 to obtain reduced foreground directional information $55_k$ (136). The audio decoding device 24 may also invoke the psychoacoustic decoding unit 80. The psychoacoustic audio coding unit 80 may decode the encoded ambient HOA coefficients 59 and the encoded foreground signals 61 to obtain energy compensated ambient HOA coefficients 47' and the interpolated foreground signals 49' (138). The psychoacoustic decoding unit 80 may pass the energy compensated ambient HOA coefficients 47' to HOA coefficient formulation unit 82 and the nFG signals 49' to the reorder unit 84.

The reorder unit 84 may receive syntax elements indicative of the original order of the foreground components of the HOA coefficients 11. The reorder unit 84 may, based on these reorder syntax elements, reorder the interpolated nFG signals 49' and the reduced foreground V[k] vectors $\mathbf{55}_k$ to generate reordered nFG signals 49" and reordered foreground V[k] vectors $\mathbf{55}_k'$ (140). The reorder unit 84 may output the reordered nFG signals 49" to the foreground formulation unit 78 and the reordered foreground V[k] vectors $\mathbf{55}_k'$ to the spatio-temporal interpolation unit 76.

The audio decoding device 24 may next invoke the spatio-temporal interpolation unit 76. The spatio-temporal interpolation unit 76 may receive the reordered foreground directional information $\mathbf{55}_k'$ and perform the spatio-temporal interpolation with respect to the reduced foreground directional information $\mathbf{55}_k/\mathbf{55}_{k-1}$ to generate the interpolated foreground directional information $\mathbf{55}_k''$ (142). The spatio-temporal interpolation unit 76 may forward the interpolated foreground V[k] vectors $\mathbf{55}_k''$ to the foreground formulation unit 718.

The audio decoding device 24 may invoke the foreground formulation unit 78. The foreground formulation unit 78 may perform matrix multiplication the interpolated foreground signals 49" by the interpolated foreground directional information $\mathbf{55}_k''$ to obtain the foreground HOA coefficients 65 (144). The audio decoding device 24 may also invoke the HOA coefficient formulation unit 82. The HOA coefficient formulation unit 82 may add the foreground HOA coefficients 65 to ambient HOA channels 47' so as to obtain the HOA coefficients 11' (146).

In this respect, three dimensional (3D) (or HOA-based) audio may be designed to go beyond 5.1 or even 7.1 channel-based surround sound to provide a more vivid soundscape. In other words, the 3D audio may be designed to envelop the listener so that the listener feels like the source of the sound, whether the musician or the actor for example, is performing live in the same room as the listener. The 3D audio may present new options for content creators looking to craft greater depth and realism into digital soundscapes.

3D audio coding, described in detail above, may include a novel scene-based audio HOA representation format that may be designed to overcome some limitations of traditional audio coding. Scene based audio may represent the three dimensional sound scene (or equivalently the pressure field) using a very efficient and compact set of signals known as higher order ambisonics (HOA) based on spherical harmonic basis functions.

In some instances, content creation may be closely tied to how the content will be played back. The scene based audio format (such as those defined in the above referenced MPEG-H 3D audio standard) may support content creation of one single representation of the sound scene regardless of the system that plays the content. In this way, the single representation may be played back on a 5.1, 7.1, 7.4.1, 11.1, 22.2, etc. playback system. Because the representation of the sound field may not be tied to how the content will be played back (e.g. over stereo or 5.1 or 7.1 systems), the scene-based audio (or, in other words, HOA) representation is designed to be played back across all playback scenarios. The scene-based audio representation may also be amenable for both live capture and for recorded content and may be engineered to fit into existing infrastructure for audio broadcast and streaming as described above.

Although described as a hierarchical representation of a soundfield, the HOA coefficients may also be characterized as a scene-based audio representation. As such, the mezzanine compression or encoding may also be referred to as a scene-based compression or encoding.

The scene based audio representation may offer several value propositions to the broadcast industry, such as the following:

- Potentially easy capture of live audio scene: Signals captured from microphone arrays and/or spot microphones may be converted into HOA coefficients in real time.
- Potentially flexible rendering: Flexible rendering may allow for the reproduction of the immersive auditory scene regardless of speaker configuration at playback location and on headphones.
- Potentially minimal infrastructure upgrade: The existing infrastructure for audio broadcast that is currently employed for transmitting channel based spatial audio (e.g. 5.1 etc.) may be leveraged without making any significant changes to enable transmission of HOA representation of the sound scene.

In this respect, the techniques may provide for a method set forth below with respect to the following clauses. A device or a system (such as the system 10 of FIG. 1, the broadcast network center 402 of FIGS. 2-3C and/or the spatial audio encoding device 20) may be configured to perform (in the form of means or by way of one or more processors and a memory or other hardware components discussed herein) the method. In some examples, a non-transitory computer-readable storage medium having stored thereon instructions that may cause one or more processors to perform the method set forth in the following clauses.

Clause 1A. A method comprising performing mezzanine (or, in other words, an intermediate) compression with respect to higher order ambisonic audio data to obtain mezzanine (or, in other words, intermediately) formatted audio data.

Clause 2A. The method of clause 1A, wherein performing the mezzanine compression comprises performing the mezzanine compression that does not involve any application of psychoacoustic audio encoding with respect to the higher order ambisonic audio data to obtain the mezzanine formatted audio data.

Clause 3A. The method of clause 1A, wherein performing mezzanine compression comprises performing spatial audio encoding with respect to the higher order ambisonic audio data to obtain the mezzanine formatted audio data.

Clause 4A. The method of clause 1A, wherein performing mezzanine compression comprises performing a vector-based synthesis with respect to the higher order ambisonic audio data to obtain the mezzanine formatted audio data.

Clause 5A. The method of clause 4A, wherein performing the vector-based synthesis comprises performing a singular value decomposition with respect to the higher order ambisonic audio data to obtain the mezzanine formatted audio data.

Clause 6A. The method of clause 1A, wherein the mezzanine formatted audio data includes one or more background components of a soundfield represented by the higher order ambisonic audio data.

Clause 7A. The method of clause 6A, wherein the background components include higher order ambisonic coefficients of the higher order ambisonic audio data corresponding to spherical basis function having an order less than two.

Clause 8A. The method of clause 6A, wherein the background components only include higher order ambisonic coefficients of the higher order ambisonic audio data corresponding to spherical basis function having an order less than two.

Clause 9A. The method of clause 1A, wherein the mezzanine formatted audio data includes one or more foreground components of a soundfield represented by the higher order ambisonic audio data.

Clause 10A. The method of clause 9A, wherein performing mezzanine compression comprises performing a vector-based synthesis with respect to the higher order ambisonic audio data to obtain the mezzanine formatted audio data, and wherein the foreground components include foreground audio objects decomposed from the higher order audio objects by performing the vector-based synthesis with respect to the higher order ambisonic audio data.

Clause 11A. The method of clause 1A, wherein the mezzanine formatted audio data includes one or more background components and one or more foreground components of a soundfield represented by the higher order ambisonic audio data.

Clause 12A. The method of clause 1A, wherein the mezzanine formatted audio data includes one or more pulse code modulated (PCM) transport channels and sideband information.

Clause 13A. The method of clause 12A, wherein performing mezzanine compression comprises performing a vector-based synthesis with respect to the higher order ambisonic audio data to obtain the mezzanine formatted audio data, and wherein the sideband information includes directional information output as a result of performing the vector-based synthesis with respect to the higher order ambisonic audio data.

Clause 14A. The method of clause 12A, wherein performing mezzanine compression comprises performing a singular value decomposition with respect to the higher order ambisonic audio data to obtain the mezzanine formatted audio data, and wherein the sideband information includes one or more V vectors output as a result of performing the vector-based synthesis with respect to the higher order ambisonic audio data.

Clause 15A. The method of clause 1A, further comprising transmitting the mezzanine formatted audio data to a broadcasting network for processing by the broadcasting network.

Clause 16A. The method of clause 1A, further comprising transmitting the mezzanine formatted audio data to a broadcasting network for insertion of additional audio data into the mezzanine formatted audio data prior to broadcasting the mezzanine formatted audio data.

The techniques may also provide for a method set forth below with respect to the following clauses. A device or a system (such as the system 10 of FIG. 1, the broadcast network center 402 of FIGS. 2-3C, the audio decoding device 24 of FIGS. 2 and 6, and/or the spatial audio decoding device 420 of FIGS. 2A-2C and 7) may be configured to perform (in the form of means or by way of one or more processors and a memory or other hardware components discussed herein) the method. In some examples, a non-transitory computer-readable storage medium having stored thereon instructions that may cause one or more processors to perform the method set forth in the following clauses.

Clause 1B. A method comprising obtaining, by a broadcasting network, mezzanine (or, in other words, intermediately) formatted audio data generated as a result of performing mezzanine (or, in other words, an intermediate) compression with respect to higher order ambisonic audio data, and processing, by the broadcasting network, the mezzanine formatted audio data.

Clause 2B. The method of clause 1B, wherein the mezzanine formatted audio data is generated as a result of performing a mezzanine compression that does not involve any application of psychoacoustic audio encoding to the higher order ambisonic audio data.

Clause 3B. The method of clause 1B, wherein the mezzanine formatted audio data is generated as a result of performing spatial audio encoding with respect to the higher order ambisonic audio data.

Clause 4B. The method of clause 1B, wherein the mezzanine formatted audio data is generated as a result of performing a vector-based synthesis with respect to the higher order ambisonic audio data.

Clause 5B. The method of clause 1B, wherein the mezzanine formatted audio data is generated as a result of performing a singular value decomposition with respect to the higher order ambisonic audio data.

Clause 6B. The method of clause 1B, wherein the mezzanine formatted audio data includes one or more background components of a soundfield represented by the higher order ambisonic audio data.

Clause 7B. The method of clause 6B, wherein the background components include higher order ambisonic coefficients of the higher order ambisonic audio data corresponding to spherical basis function having an order less than two.

Clause 8B. The method of clause 6B, wherein the background components only include higher order ambisonic coefficients of the higher order ambisonic audio data corresponding to spherical basis function having an order less than two.

Clause 9B. The method of clause 1B, wherein the mezzanine formatted audio data includes one or more foreground components of a soundfield represented by the higher order ambisonic audio data.

Clause 10B. The method of clause 9B, wherein the mezzanine formatted audio data is generated as a result of performing a vector-based synthesis with respect to the higher order ambisonic audio data, and wherein the foreground components include foreground audio objects decomposed from the higher order audio objects by performing the vector-based synthesis with respect to the higher order ambisonic audio data.

Clause 11B. The method of clause 1B, wherein the mezzanine formatted audio data includes one or more background components and one or more foreground components of a soundfield represented by the higher order ambisonic audio data.

Clause 12B. The method of clause 1B, wherein the mezzanine formatted audio data includes one or more pulse code modulated (PCM) transport channels and sideband information.

Clause 13B. The method of clause 12B, wherein the mezzanine formatted audio data is generated as a result of performing a vector-based synthesis with respect to the higher order ambisonic audio data to obtain the mezzanine formatted audio data, and wherein the sideband information includes directional information output as a result of performing the vector-based synthesis with respect to the higher order ambisonic audio data.

Clause 14B. The method of clause 12B, wherein the mezzanine formatted audio data is generated as a result of performing a singular value decomposition with respect to the higher order ambisonic audio data to obtain the mezzanine formatted audio data, and wherein the sideband information includes one or more V vectors output as a result of performing the vector-based synthesis with respect to the higher order ambisonic audio data.

Clause 15B. The method of clause 1B, wherein processing the mezzanine formatted audio data comprises inserting additional audio data into the mezzanine formatted audio data.

Clause 16B. The method of clause 1B, wherein processing the mezzanine formatted audio data comprises inserting commercial audio data into the mezzanine formatted audio data.

Clause 17B. The method of clause 1B, wherein processing the mezzanine formatted audio data comprises inserting a television studio show into the mezzanine formatted audio data.

Clause 18B. The method of clause 1B, wherein processing the mezzanine formatted audio data comprises crossfading additional audio data into the mezzanine formatted audio data.

Clause 19B. The method of clause 1B, wherein processing the mezzanine formatted audio data comprises processing the mezzanine formatted audio data without performing either of mezzanine decompression or higher order ambisonic conversion with respect to the mezzanine formatted audio data.

Clause 20B. The method of claim 1B, further comprising obtaining additional audio data specified in a spatial domain, converting the additional audio data from the spatial domain to a spherical harmonic domain such that a soundfield described by the additional audio data is represented as additional higher order ambisonic audio data, and performing mezzanine compression with respect to the additional higher order ambisonic audio data to generate mezzanine formatted additional audio data, wherein processing the mezzanine formatted audio data comprises inserting mezzanine formatted additional audio data into the mezzanine formatted audio data.

Clause 21B. The method of clause 1B, further comprising obtaining mezzanine formatted additional audio data specified in a spherical harmonic domain, wherein processing the mezzanine formatted audio data comprises inserting mezzanine formatted additional audio data into the mezzanine formatted audio data.

Clause 22B. The method of clause 1B, further comprising:

obtaining additional higher order ambisonic audio data specified in a spherical harmonic domain, and performing mezzanine compression with respect to the additional higher order ambisonic audio data to generate mezzanine formatted additional audio data, wherein processing the mezzanine formatted audio data comprises inserting mezzanine formatted additional audio data into the mezzanine formatted audio data.

Clause 23B. The method of clause 1B, further comprising performing psychoacoustic audio encoding with respect to the mezzanine formatted audio data to generate compressed audio data.

Clause 24B. The method of clause 1B, further comprising performing mezzanine decompression with respect to the mezzanine formatted audio data to obtain the higher order ambisonic audio data, performing higher order ambisonic conversion with respect to the higher order ambisonic audio data to obtain spatially formatted audio data, and monitoring the spatially formatted audio data.

In addition, the foregoing techniques may be performed with respect to any number of different contexts and audio ecosystems and should not be limited to any of the contexts or audio ecosystems described above. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20 of FIG. 5.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20 of FIG. 5.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Moreover, as used herein, "A and/or B" means "A or B", or both "A and B."

Various aspects of the techniques have been described. These and other aspects of the techniques are within the scope of the following claims.

The invention claimed is:

1. A device configured to operate within a broadcasting system, the device comprising:

a memory configured to store an intermediately formatted audio data generated as a result of an intermediate compression of higher order ambisonic audio data, the intermediate compression of the higher order ambisonic audio being performed to reduce a number of channels of the higher order ambisonic audio data such that the intermediately formatted audio data has a number of channels less than or equal to a number of channels supported by the device; and one or more processors configured to perform, at the broadcasting system, psychoacoustic audio encoding with respect to the intermediately formatted audio data to generate compressed audio data.

2. The device of claim 1, wherein the intermediately formatted audio data includes one or more pulse code modulated (PCM) transport channels and sideband information.

3. The device of claim 1, wherein the one or more processors are configured to insert additional audio data into the intermediately formatted audio data.

4. The device of claim 1, wherein the one or more processors are configured to insert commercial audio data into the intermediately formatted audio data.

5. The device of claim 1, wherein the one or more processors are configured to insert audio associated with a television studio show into the intermediately formatted audio data.

6. The device of claim 1, wherein the one or more processors are configured to crossfade additional audio data into the intermediately formatted audio data.

7. The device of claim 1, wherein the one or more processors are configured to process the intermediately formatted audio data without performing either of an intermediate decompression or higher order ambisonic conversion with respect to the intermediately formatted audio data.

8. The device of claim 1, wherein the one or more processors are further configured to obtain additional audio data specified in a spatial domain, convert the additional audio data from the spatial domain to a spherical harmonic domain such that a soundfield described by the additional audio data is represented as additional higher order ambisonic audio data, and perform the intermediate compression with respect to the additional higher order ambisonic audio data to generate intermediately formatted additional audio data, and wherein the one or more processors are configured to insert the intermediately formatted additional audio data into the intermediately formatted audio data.

9. The device of claim 1, wherein the one or more processors are further configured to obtain intermediately formatted additional audio data specified in a spherical harmonic domain, and wherein the one or more processors are configured to insert the intermediately formatted additional audio data into the intermediately formatted audio data.

10. The device of claim 1, wherein the one or more processors are further configured to obtain additional higher order ambisonic audio data specified in a spherical harmonic domain, and perform the intermediate compression with respect to the additional higher order ambisonic audio data to generate intermediately formatted additional audio data, and wherein the one or more processors are configured to insert the intermediately formatted additional audio data into the intermediately formatted audio data.

11. The device of claim 1, wherein the one or more processors are further configured to perform intermediate decompression with respect to the intermediately formatted audio data to obtain the higher order ambisonic audio data, perform higher order ambisonic conversion with respect to the higher order ambisonic audio data to obtain spatially formatted audio data, and monitor the spatially formatted audio data.

12. A method comprising:

obtaining, by a broadcasting system, intermediately formatted audio data generated as a result of an intermediate compression of higher order ambisonic audio data, the intermediate compression of the higher order ambisonic audio being performed to reduce a number of channels of the higher order ambisonic audio data such that the intermediately formatted audio data has a number of channels less than or equal to a number of channels supported by the broadcasting system; and performing, by the broadcasting system, psychoacoustic audio encoding with respect to the intermediately formatted audio data to generate compressed audio data.

13. A non-transitory computer-readable storage medium having stored thereon instructions that, when executed, cause one or more processors to of a broadcasting system to:

obtain intermediately formatted audio data generated as a result of an intermediate compression of higher order ambisonic audio data, the intermediate compression of the higher order ambisonic audio being performed to reduce a number of channels of the higher order ambisonic audio data such that the intermediately formatted audio data has a number of channels less than or equal to a number of channels supported by the broadcasting system; and perform psychoacoustic audio encoding with respect to the intermediately formatted audio data to generate compressed audio data.

14. A device comprising:

a memory configured to store higher order ambisonic audio data; and one or more processors configured to perform intermediate compression that includes application of a linear decomposition with respect to the higher order ambisonic audio data to reduce a number of channels of the higher order audio data and thereby obtain intermediately formatted audio data having a number of channels less than or equal to a number of channels supported by a broadcasting network.

15. The device of claim 14, wherein the one or more processors are configured to perform the intermediate compression that does not involve any application of psychoacoustic audio encoding with respect to the higher order ambisonic audio data to obtain the intermediately formatted audio data.

16. The device of claim 14, wherein the one or more processors are configured to perform spatial audio encoding that includes application of the linear decomposition with respect to the higher order ambisonic audio data to obtain the intermediately formatted audio data.

17. The device of claim 14, wherein the intermediately formatted audio data includes one or more background components of a soundfield represented by the higher order ambisonic audio data.

18. The device of claim 17, wherein the background components include higher order ambisonic coefficients of the higher order ambisonic audio data corresponding to spherical basis function having an order less than two.

19. The device of claim 17, wherein the background components only include higher order ambisonic coefficients of the higher order ambisonic audio data corresponding to spherical basis function having an order less than two.

20. The device of claim 14, wherein the intermediately formatted audio data includes one or more foreground components of a soundfield represented by the higher order ambisonic audio data.

21. The device of claim 20, wherein the foreground components include foreground audio objects decomposed from the higher order audio objects by performing the linear decomposition with respect to the higher order ambisonic audio data.

22. The device of claim 14, wherein the intermediately formatted audio data includes one or more background components and one or more foreground components of a soundfield represented by the higher order ambisonic audio data.

23. The device of claim 14, wherein the intermediately formatted audio data includes one or more pulse code modulated (PCM) transport channels and sideband information.

24. The device of claim 23, wherein the sideband information includes directional information output as a result of performing the linear decomposition with respect to the higher order ambisonic audio data.

25. The device of claim 23, wherein the sideband information includes one or more V vectors output as a result of performing the linear decomposition with respect to the higher order ambisonic audio data.

26. The device of claim 14, wherein the one or more processors are further configured to transmit the intermediately formatted audio data to the broadcasting network for processing by the broadcasting network.

27. The device of claim 14, wherein the one or more processors are further configured to transmit the intermediately formatted audio data to the broadcasting network for insertion of additional audio data into the intermediately formatted audio data prior to broadcasting the intermediately formatted audio data.

* * * * *